US009250562B2

(12) United States Patent
Akagi

(10) Patent No.: US 9,250,562 B2
(45) Date of Patent: Feb. 2, 2016

(54) IMAGE FORMING APPARATUS

(71) Applicant: CANON KABUSHIKI KAISHA, Tokyo (JP)

(72) Inventor: Daisuke Akagi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/676,322

(22) Filed: Apr. 1, 2015

(65) Prior Publication Data

US 2015/0286160 A1 Oct. 8, 2015

(30) Foreign Application Priority Data

Apr. 2, 2014 (JP) ..... 2014-076459

(51) Int. Cl.
*G03G 15/043* (2006.01)

(52) U.S. Cl.
CPC ..... *G03G 15/043* (2013.01)

(58) Field of Classification Search
CPC ..... G03G 15/043; G03G 15/04072; G03G 15/04; G03G 15/0435
See application file for complete search history.

(56) References Cited

U.S. PATENT DOCUMENTS 9,091,955 B2 * 7/2015 Seki ..... G03G 15/04072
2015/0180200 A1 * 6/2015 Fujita ..... H01S 5/0427 347/247

FOREIGN PATENT DOCUMENTS

JP 2008089695 A 4/2008

* cited by examiner

*Primary Examiner* — Sarah Al Hashimi
(74) *Attorney, Agent, or Firm* — Rossi, Kimms & McDowell LLP

(57) ABSTRACT

An image forming apparatus causes a BD sensor to generate two BD signals based on laser beams emitted from first and second light-emitting portions and measures the generation timing difference therebetween. When measurement is to be executed, the image forming apparatus executes APC as light power control on the first light-emitting portion that emits a laser beam for causing the BD sensor 210 to generate the first BD signal. On the other hand, the image forming apparatus executes ACC, rather than APC, as light power control on the second light-emitting portion that emits a laser beam for causing the BD sensor to generate the second BD signal that follows the first BD signal.

13 Claims, 11 Drawing Sheets

FIG. 7A

| | DIS | APCH | | APCM | | APCL | | ACC | | VDO | OFF |
|---|---|---|---|---|---|---|---|---|---|---|---|
| Isw | OFF | ON | OFF | ON | OFF | ON | OFF | ON | OFF | ON | OFF |
| Ib | OFF | ON | ON | ON | ON | ON | ON | ON | ON | ON | ON |
| ms3 | L | L | L | L | L | L | L | H | H | H | [1] |
| ms2 | L | L | L | L | L | H | H | L | L | H | [1] |
| ms1 | L | L | L | H | H | L | L | L | L | H | [1] |
| ms0 | L | H | H | L | L | L | L | H | H | H | [1] |
| ic | [*] | L | H | L | H | L | H | L | H | [*] | [*] |
| ch3 | [*] | [2] | [*] | [2] | [*] | [2] | [*] | [2] | [*] | [*] | [*] |
| ch2 | [*] | [2] | [*] | [2] | [*] | [2] | [*] | [2] | [*] | [*] | [*] |
| ch1 | [*] | [2] | [*] | [2] | [*] | [2] | [*] | [2] | [*] | [*] | [*] |
| ch0 | [*] | [2] | [*] | [2] | [*] | [2] | [*] | [2] | [*] | [*] | [*] |

FIG. 7B

| | e1 | e2 | e3 | e4 | e5 | e6 | e7 | e8 | e9 | e10 | e11 | e12 | e13 | e14 | e15 | e16 |
|---|---|---|---|---|---|---|---|---|---|---|---|---|---|---|---|---|
| ch3 | L | L | L | L | L | L | L | L | H | H | H | H | H | H | H | H |
| ch2 | L | L | L | L | H | H | H | H | L | L | L | L | H | H | H | H |
| ch1 | L | L | H | H | L | L | H | H | L | L | H | H | L | L | H | H |
| ch0 | L | H | L | H | L | H | L | H | L | H | L | H | L | H | L | H |

IMAGE FORMING APPARATUS

BACKGROUND OF THE INVENTION

1. Field of the Invention

The present invention relates to an electrophotographic image forming apparatus.

2. Description of the Related Art

Conventionally, there are known to be image forming apparatuses that form electrostatic latent images on a photosensitive member by using a rotating polygonal mirror to deflect a light beams emitted from a light source and scanning the photosensitive member with the deflected light beams. This kind of image forming apparatus includes an optical sensor (beam detection (BD) sensor) for detecting the light beams deflected by the rotating polygonal mirror, and the optical sensor generates a synchronization signal upon detecting the light beam. By causing the light beams to be emitted from the light source at a timing determined using the synchronization signals generated by the optical sensor as a reference, the image forming apparatus aligns the writing start positions for the electrostatic latent image (image) in the direction (main scanning direction) in which the light beams scan the photosensitive member.

Also, there are known to be image forming apparatuses that include multiple light-emitting portions (light emitting elements) as a light source for emitting multiple light beams that each scan a different line on the photosensitive member in parallel in order to realize a higher image formation speed and higher resolution images. With this kind of multi-beam image forming apparatus, a higher image formation speed is realized by scanning multiple lines in parallel using multiple light beams, and higher resolution images are realized by adjusting the interval between the lines in the sub-scanning direction.

Japanese Patent Laid-Open No. 2008-89695 discloses an image forming apparatus that includes multiple light-emitting portions (light emitting elements) as a light source and is capable of adjusting the resolution in the sub-scanning direction by performing rotational adjustment of the light source in the plane in which the light-emitting portions are arranged. This kind of resolution adjustment is performed in the step of assembling the image forming apparatus. Japanese Patent Laid-Open No. 2008-89695 discloses a technique for suppressing misalignment in the writing start positions in the main scanning direction for the electrostatic latent image that occurs due to light source attachment errors in the assembly step. Specifically, the image forming apparatus uses a BD sensor to detect light beams emitted from a first light-emitting portion and a second light-emitting portion and generates multiple BD signals. Furthermore, the image forming apparatus sets a light beam emission timing for the second light-emitting portion relative to the light beam emission timing for the first light-emitting portion based on the generation timing difference between the generated BD signals. This compensates for light source attachment errors in the assembly step and suppresses misalignment in the writing start positions for the electrostatic latent image between the light-emitting portions.

However, the following problems are present in the method of measuring the generation timing difference between BD signals generated by the BD sensor as described above, in an optical scanning apparatus (image forming apparatus) including multiple light-emitting portions (light emitting elements) as a light source. Usually, the response speed of the BD sensor when a light beam is incident on the BD sensor changes according to the incident light power. If there is variation in the incident light power, on the BD sensor, of the multiple light beams used for measuring the time interval between the BD signals (BD interval), variation will appear in the measurement result of the time interval between the pulses (BD signals) generated by the BD sensor, and a measurement error can occur. For this reason, when BD interval measurement is to be executed, the incident light power, on the BD sensor, of the multiple light beams used in measurement needs to be made constant.

In order to make the light power of the light beams incident on the BD sensor from the light-emitting portions constant, it needs to execute automatic power control (APC) according to which the light power of the light beams emitted from the light-emitting portions is controlled so as to be a constant light power (target light power). Usually, due to the execution of APC, several milliseconds of time are needed from when the light-emitting portions start emitting light to when the light-emitting portions enter a state of being stable at a constant light power (target light power). For this reason, when BD interval measurement is to be performed, if sufficient time for executing APC on the light-emitting portions used in measurement cannot be reserved, there is a possibility that it will not be possible to stabilize the light power of the light beams emitted by the light-emitting portions at a constant light power and that the above-described measurement error will occur.

SUMMARY OF THE INVENTION

The present invention has been made in view of the foregoing problems. The present invention provides a technique for, when a generation timing difference between detection signals corresponding to light beams emitted from two light-emitting portions is to be measured in an image forming apparatus using a light source including multiple light-emitting portions, reducing measurement error by stabilizing the light power of the light beams.

According to one aspect of the present invention, there is provided an image forming apparatus comprising: a light source including a plurality of light-emitting portions that are each configured to emit a light beam for exposing a photosensitive member; a first light receiving unit configured to receive a plurality of light beams emitted from the plurality of light-emitting portions; a deflection unit configured to deflect a plurality of light beams emitted from the plurality of light-emitting portions, such that the plurality of light beams scan the photosensitive member; a second light receiving unit configured to, in response to receiving a light beam deflected by the deflection unit, generate a detection signal indicating that the light beam has been received; a current control unit configured to execute light power control of causing the plurality of light-emitting elements to emit light individually and controlling a driving current which is supplied to each of the plurality of light-emitting portions based on a light reception result of the first light receiving unit receiving a light beam emitted from each of the plurality of the light-emitting portions, and supply a driving current with a pre-determined value to at least a second light-emitting portion among the plurality of light-emitting portions, the current control unit being configured to supply driving currents to a first light-emitting portion and the second light-emitting portion among the plurality of light-emitting portions such that light beams emitted from the first light-emitting portion and the second light-emitting portion are incident on the second light receiving unit in sequence; and a timing control unit configured to measure a time interval between a first detection signal generated due to the second light receiving unit receiving a light beam from the first light-emitting portion and a second detection signal generated due to the second light receiving unit receiving a light beam from the second light-emitting portion, and based on the time interval, control relative emission timings according to which the plurality of light-emitting portions emit the plurality of light beams, wherein the current control unit is configured to: cause the second light receiving unit to generate the first detection signal by supplying, to the first light-emitting portion, a driving current with a value based on a light reception result of the first light receiving unit receiving the light beam emitted from the first light-emitting portion; and cause the second light receiving unit to generate the second detection signal by supplying a driving current with a pre-determined value to the second light-emitting portion.

According to the present invention, it is possible to provide a technique for, when a generation timing difference between detection signals corresponding to light beams emitted from two light-emitting portions is to be measured in an image forming apparatus using a light source including multiple light-emitting portions, reducing measurement error by stabilizing the light power of the light beams.

Further features of the present invention will become apparent from the following description of exemplary embodiments with reference to the attached drawings.

BRIEF DESCRIPTION OF THE DRAWINGS

FIGS. 7A and 7B are diagrams showing a control mode.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

Image Forming Apparatus

Figure 1:
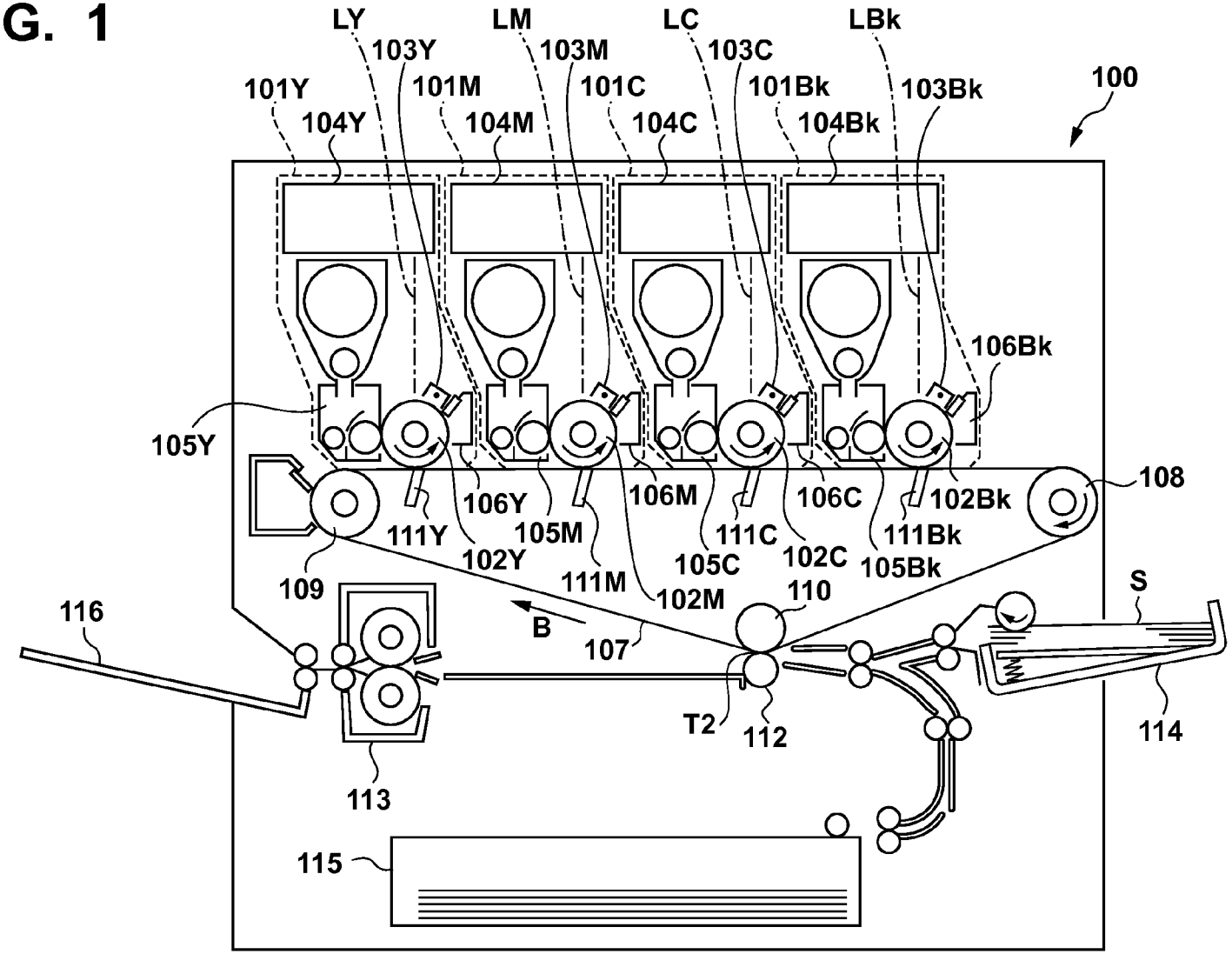
FIG. 1 is an overall cross-sectional diagram showing an image forming apparatus according to an embodiment of the present invention.

Embodiments will be described hereinafter taking, as an example, an electrophotographic color image forming apparatus. FIG. 1 is an overall cross-sectional view of a color image forming apparatus. An image forming apparatus 100 shown in FIG. 1 is a full-color printer that forms images using multiple colors of toner. Note that in the description below, a full-color printer will be described as an example of an image forming apparatus, but another image forming apparatus, for example, a monochrome printer that forms images with one color of toner (e.g., black), or a color or monochrome copying apparatus including an image reading device may be used.

In FIG. 1, the image forming apparatus 100 has image forming units 101Y, 101M, 101C, and 101Bk, which each form an image of a corresponding color. The image forming units 101Y, 101M, 101C, and 101Bk form images using yellow (Y), magenta (M), cyan (C), and black (Bk) toner respectively.

The image forming units 101Y, 101M, 101C, and 101Bk include photosensitive drums 102Y, 102M, 102C, and 102Bk respectively, which are photosensitive members. Charging devices 103Y, 103M, 103C, and 103Bk, optical scanning apparatuses 104Y, 104M, 104C, and 104Bk, and developing devices 105Y, 105M, 105C, and 105Bk are arranged in the periphery of the photosensitive drums 102Y, 102M, 102C, and 102Bk respectively.

Furthermore, drum cleaning devices 106Y, 106M, 106C, and 106Bk are arranged in the peripheries of the photosensitive drums 102Y, 102M, 102C, and 102Bk respectively.

An endless intermediate transfer belt 107 (intermediate transfer member) is arranged below the photosensitive drums 102Y, 102M, 102C, and 102Bk. The intermediate transfer belt 107 is extended between a driving roller 108 and driven rollers 109 and 110, and is driven so as to rotate in the direction of arrow B shown in FIG. 1 while image formation is being performed. Also, primary transfer devices 111Y, 111M, 111C, and 111Bk are arranged at positions opposing the photosensitive drums 102Y, 102M, 102C, and 102Bk respectively, via the intermediate transfer belt 107.

Also, the image forming apparatus 100 includes a secondary transfer device 112 for transferring a toner image on the intermediate transfer belt 107 to a recording medium S, and includes a fixing device 113 for fixing the toner image on the recording medium S.

Next, an image forming process performed by the image forming apparatus 100 will be described. Note that the image forming processes performed by each of the image forming units 101Y, 101M, 101C, and 101Bk are the same. For this reason, hereinafter, a description will be given taking the image forming process of the image forming unit 101Y as an example, and the description will not be repeated for the image forming processes of the image forming units 101M, 101C, and 101Bk.

First, the surface of the photosensitive drum 102Y that is driven so as to rotate in the rotation direction indicated by the arrow in FIG. 1 is uniformly charged by the charging device 103Y. Then, the charged photosensitive drum 102Y is exposed using a laser beam LY (light beam) emitted from the optical scanning apparatus 104Y. This forms an electrostatic latent image on the photosensitive drum 102Y. Thereafter, the electrostatic latent image is developed by the developing device 105Y, and a yellow toner image is formed on the photosensitive drum 102Y.

The primary transfer devices 111Y, 111M, 111C, and 111Bk apply a transfer bias to the intermediate transfer belt 107. Accordingly, the yellow, magenta, cyan, and black toner images on the photosensitive drums 102Y, 102M, 102C, and 102Bk are transferred onto the intermediate transfer belt 107. As a result, a multi-color toner image (color toner image) is formed on the intermediate transfer belt 107.

The color toner image on the intermediate transfer belt 107 is transferred by the secondary transfer device 112 onto a recording medium S that has been conveyed from a manual feed cassette 114 or a paper feeding cassette 115 to a secondary transfer portion T2. Then, the color toner image on the recording medium S undergoes thermal fixing by a fixing device 113, and thereafter, the recording medium S is discharged to a discharge portion 116.

Note that remaining toner that is not transferred onto the intermediate belt 107 and remains on the photosensitive drums 102Y, 102M, 102C, and 102Bk is removed by the drum cleaning devices 106Y, 106M, 106C, and 106Bk respectively. Thereafter, the above-described image forming process is executed again.

Optical Scanning Apparatus

Figure 2:
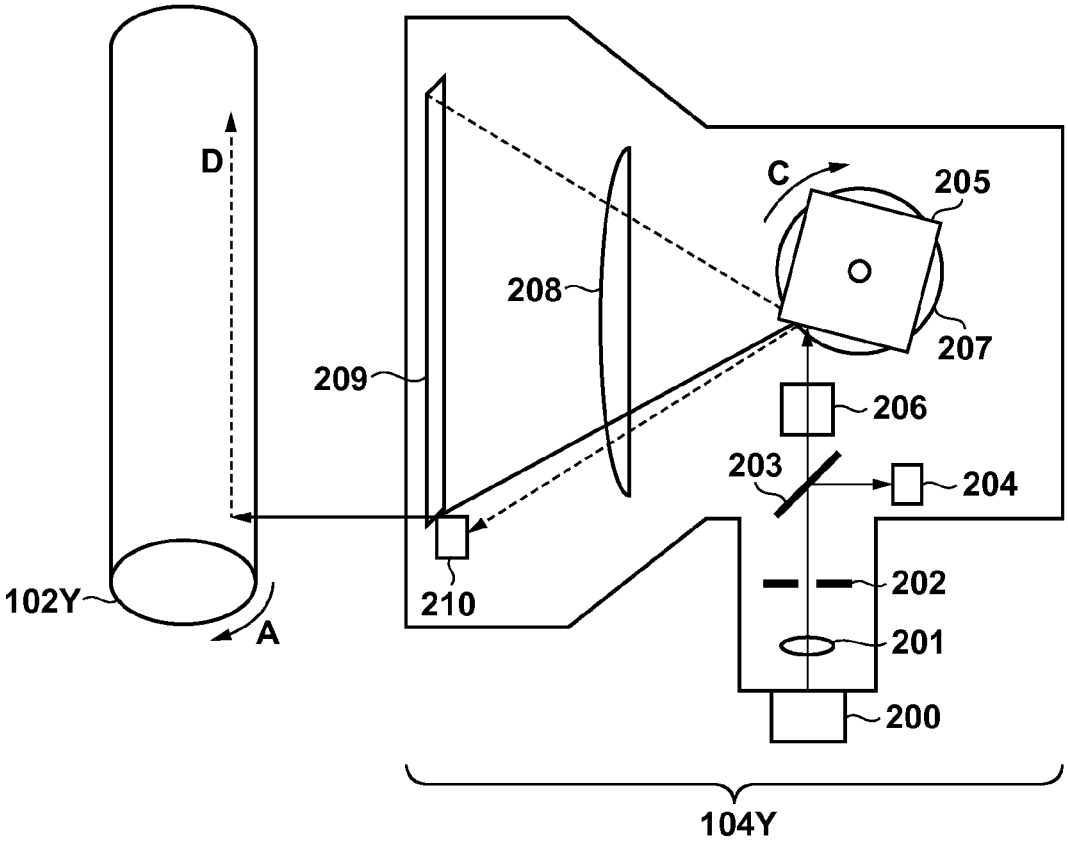
FIG. 2 is a diagram of an overall configuration of an optical scanning apparatus according to an embodiment of the present invention.

FIG. 2 is a diagram showing an overall configuration of optical scanning apparatuses 104Y, 104M, 104C, and 104Bk. The optical scanning apparatuses each have the same configuration, and therefore the optical scanning apparatus 104Y is shown as an example in FIG. 2 (and in later-described FIGS. 3A to 3C). In FIG. 2, laser beams, which are diverging beams emitted from a semiconductor laser 200, are made roughly parallel by a collimator lens 201, and an aperture 202 limits the transmission of the laser beams. This shapes the laser beams. After passing through the aperture 202, the laser beams are incident on a beam splitter 203. The beam splitter 203 divides the laser beams that have passed through the aperture 202 into laser beams that are to be incident on a photo diode (PD) 204 (first light receiving element), and laser beams that are to be received by the rotating polygonal mirror 205 (referred to below as "polygon mirror 205"), which is an example of a deflection unit. By receiving the laser beams emitted individually in a time series from multiple later-described light-emitting portions, the PD 204 emits detection signals with values (voltages) corresponding to the light power of the received laser beams, as a result of receiving light.

After passing through the beam splitter 203, the laser beams pass through a cylindrical lens 206 and are incident on the polygon mirror 205. The polygon mirror 205 includes multiple reflecting surfaces (four surfaces in the present embodiment). The polygon mirror 205 rotates in the direction of arrow C by being driven by a motor 207. The polygon mirror 205 deflects the laser beams so that the laser beams scan the photosensitive drum 102Y in the direction of arrow D. The laser beams deflected by the polygon mirror 205 pass through an imaging optical system (fθ lens) 208 having an fθ property and are guided to the photosensitive drum 102Y (photosensitive member) via a mirror 209. Thus, the polygon mirror 205 deflects the laser beams emitted from the light-emitting portions 301 to 332 such that the laser beams scan the photosensitive drum 102Y.

The optical scanning apparatus 104Y includes a beam detection (BD) sensor 210 (second light receiving element). The BD sensor 210 is arranged at a position on the scanning path of the laser beams, which is a position outside of the image forming region on the photosensitive drum 102Y. In response to the laser beam deflected by the polygon mirror 205 being received, the BD sensor 210 generates and outputs a detection signal (BD signal) indicating that the laser beam has been detected as a synchronization signal (horizontal synchronization signal).

Laser Light Source

Figure 3A:
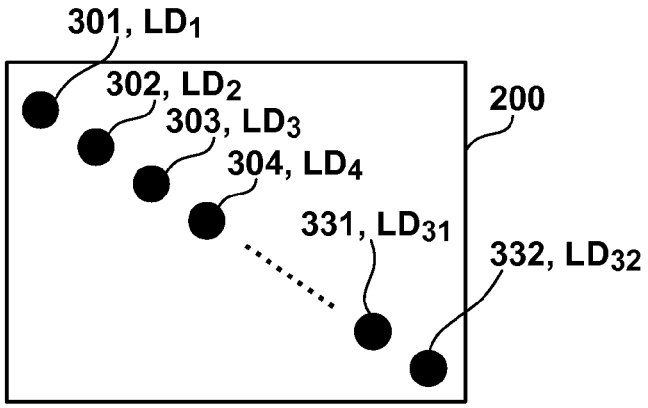
FIGS. 3A to 3C are diagrams showing an alignment of light-emitting portions of a semiconductor laser and exposure positions on a photosensitive drum.
Figure 3B:
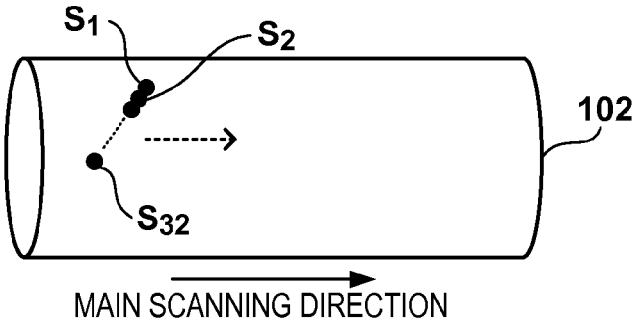

Next, a light source (laser light source) included in the optical scanning apparatuses 104Y, 104M, 104C, and 104Bk will be described. FIG. 3A shows multiple light-emitting portions included in the semiconductor laser 200 shown in FIG. 2, and FIG. 3B is a diagram showing an alignment image of laser spots on the photosensitive drum 102Y in the case where laser beams are emitted at the same time from the multiple light-emitting portions.

As shown in FIG. 3A, the semiconductor laser 200 of the present embodiment is a vertical cavity surface emitting laser (VCSEL) including 32 light-emitting portions 301 to 332. Note that not only is it possible to use a VCSEL, but it is also possible to use an edge emitting semiconductor laser as the semiconductor laser.

The light-emitting portions 301 to 332 are arranged in an array on a substrate. Since the light-emitting portions are aligned as shown in FIG. 3A, if the light-emitting portions are turned on at the same time, the laser beams $L_1$ to $L_{32}$ emitted from light-emitting portions expose different positions on the photosensitive drum 102Y in the main scanning direction, as with image forming positions $S_1$ to $S_{32}$ shown in FIG. 3B. Also, if the light-emitting portions are turned on at the same time, the laser beams $L_1$ to $L_{32}$ emitted from the light-emitting portions expose different positions in the sub-scanning direction, as with the image forming positions $S_1$ to $S_{32}$ shown in FIG. 3B. Note that FIG. 3A shows an example in which the light-emitting portions are arranged linearly in one line (one-dimensional arrangement), but the arrangement of the light-emitting portions may be a two-dimensional arrangement.

Figure 3C:
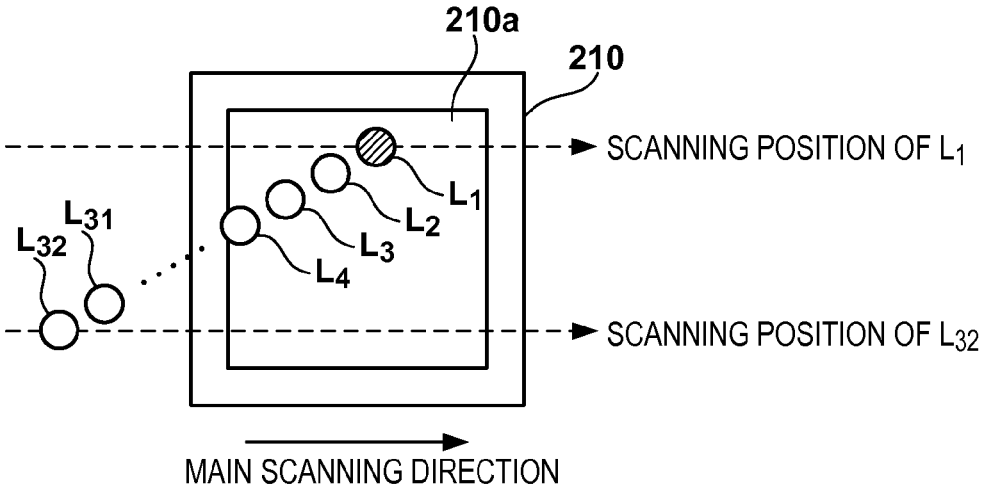

FIG. 3C is a diagram showing an overall configuration of the BD sensor 210 arranged at a position on the scanning path of the laser beams, and the positions on the BD sensor 210 that are scanned by the laser beams $L_1$ to $L_{32}$ emitted from the light-emitting portions 301 to 332 ($LD_1$ to $LD_{32}$) of the semiconductor laser 200. The BD sensor 210 includes a light-receiving surface 210*a* in which photoelectric conversion elements are arranged planarly. When a laser beam is incident on the light-receiving surface 210*a*, the BD sensor 210 generates and outputs a detection signal (BD signal) that indicates that a laser beam has been detected. As an example, FIG. 3C shows a state in which only the light-emitting portion 301 ($LD_1$) of the light-emitting portions 301 to 332 is turned on, and the laser beam $L_1$ emitted from that light-emitting portion is incident on the light-receiving surface 210*a*. In later-described BD interval measurement, by causing the laser beams $L_1$ and $L_{32}$ emitted from the light-emitting portions 301 and 332 ($LD_1$ and $LD_{32}$) to be incident in sequence on the BD sensor 210, two BD signals corresponding to laser beams are caused to be emitted in sequence from the BD sensor 210.

Control System for Image Forming Apparatus

Figure 4:
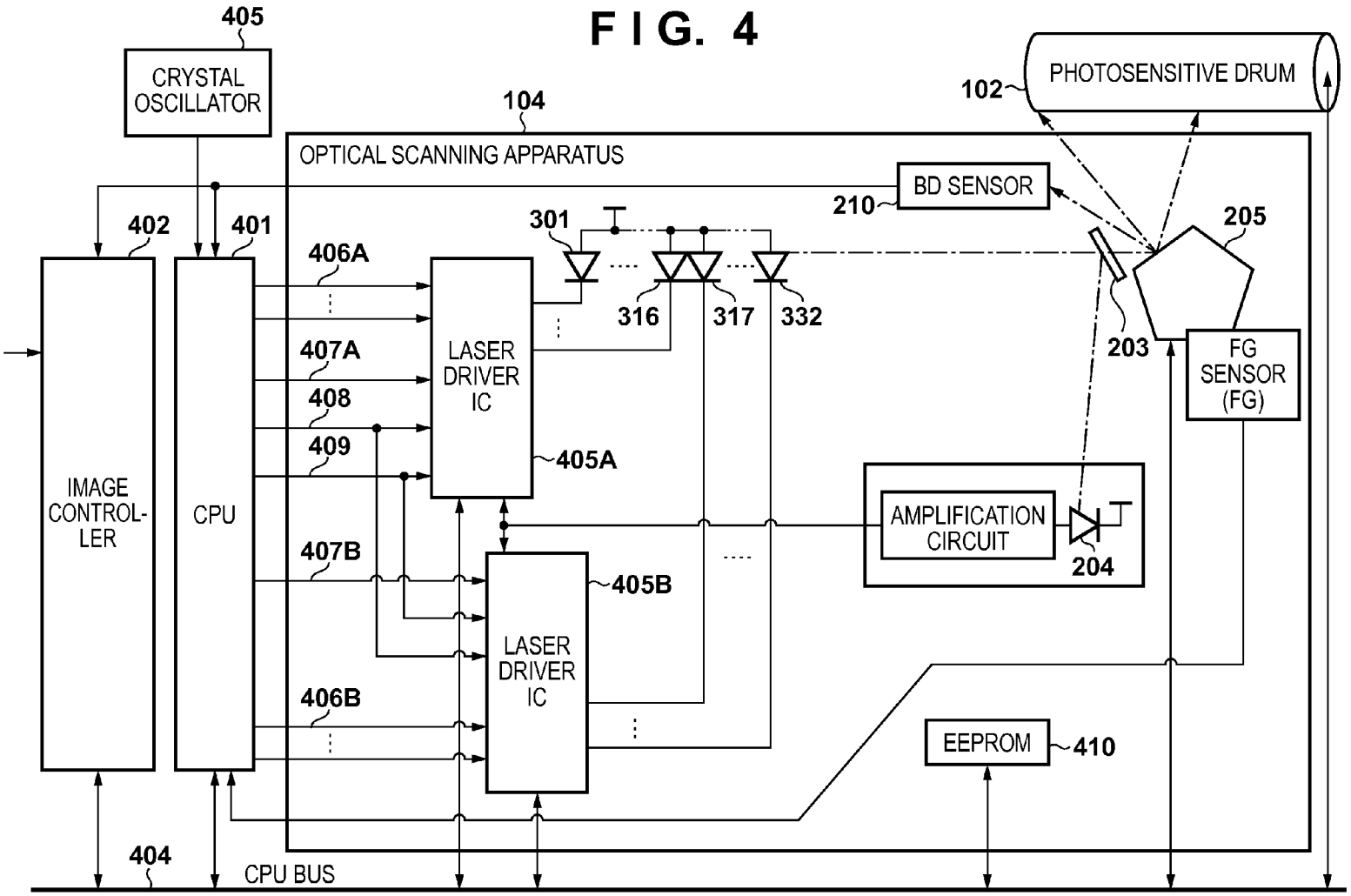
FIG. 4 is a diagram of control blocks of an image forming apparatus according to an embodiment of the present invention.

FIG. 4 is a diagram of control blocks for describing an example of a control system used by the image forming apparatus 100 shown in FIG. 1. Note that the configurations of the optical scanning apparatuses 104Y, 104M, 104C, and 104Bk are the same, and therefore the suffixes Y, M, C, and Bk will be omitted in the description below. Note that the configuration regarding the 32 beams is a parallel repeating configuration, and therefore a portion thereof is omitted in FIG. 4 and later-described FIG. 6.

The image forming apparatus 100 includes a CPU 401, an image controller 402, the optical scanning apparatus 104, the photosensitive drum 102, a crystal oscillator 405, a CPU bus 404, and an EEPROM 410. The CPU 401 and the image controller 402 are included in the main body of the image forming apparatus, and both are connected to the optical scanning apparatus 104. The optical scanning apparatus 104 has first and second laser drivers (laser driver ICs) 405A and 405B. Note that in order to simplify the description, the first and second laser drivers 405A and 405B and the light-emitting portions 301 to 332 (light emitting elements) corresponding to one color among Y, M, C, and Bk are shown in FIG. 4. In actuality, first and second laser drivers 405A and 405B and light-emitting portions 301 to 332 are provided for each color among Y, M, C, and Bk.

The CPU 401 performs overall control of the image forming apparatus including the optical scanning apparatuses 104. The CPU 401 receives a supply of a 100-MHz reference clock from the crystal oscillator 405. The CPU 401 multiplies the reference clock by 10 using a built-in PLL circuit, thereby generating a 1-GHz clock, which is an image clock for the laser scanning system.

The image controller 402 divides image data received from an external apparatus connected to the image forming apparatus 100 or the reading apparatus attached to the image forming apparatus into the four color components Y, M, C, and Bk. The image controller 402 outputs the image data for the four color components Y, M, C, and Bk to the CPU 401 via the CPU bus 404, in synchronization with the reference clock.

The CPU 401 stores the image data received from the image controller 402 in a memory (not shown) and converts the image data stored in the memory into a differential signal (low voltage differential signal (LVDS)) based on the image clock. The CPU 401 outputs the differential signal to the laser drivers 405A and 405B at a timing based on the BD signal and the image clock signal.

The laser drivers 405A and 405B each generate a PWM signal based on the differential signal input from the CPU 401, and cause laser beams for forming an electrostatic latent image to be emitted from the light-emitting portions 301 to 332 based on the PWM signals. Also, by performing automatic power control (APC), which includes later-described first light power control, second light power control, and third light power control, the laser drivers 405A and 405B control the light power of the laser beams for forming the electrostatic latent image and the values of a bias current Ib and a switching current Isw that correspond to a standby current.

The laser drivers 405A and 405B shown in FIG. 4 are ICs with the same part model number, and each controls 16 light-emitting portions. In the present embodiment, the laser driver 405A control the light-emitting portions 301 to 316, and the laser driver 405B controls the light-emitting portions 317 to 332. A DC 5-V line and a ground line are supplied from a body rear surface substrate (not shown) to the two laser drivers, and power is supplied from a common power source to the two laser drivers 405A and 405B and the light-emitting portions 301 to 332.

The CPU 401 is connected to the laser drivers 405A and 405B by the following multiple signal lines.

A signal line 406A is a group of signal lines for transmitting differential signals for driving the light-emitting portions 301 to 316 from the CPU 401 to the laser driver 405A. A signal line 406B is a group of signal lines for transmitting differential signals for driving the light-emitting portions 317 to 332 from the CPU 401 to the laser driver 405B.

A signal line 407A is a signal line connecting the CPU 401 and the laser driver 405A, and a signal line 407B is a signal line connecting the CPU 401 and the laser driver 405B.

The CPU 401 transmits an IC select signal icsel_0 to the laser driver 405A via the signal line 407A, and transmits an IC select signal icsel_1 to the laser driver 405B via the signal line 407B. If the IC select signal icsel_0 is at H (high) level, the IC select signal icsel_1 is switched to L (low) level, and if the IC select signal icsel_0 is at the L level, the IC select signal icsel_1 is switched to the H level. With the image forming apparatus 100 of the present embodiment, a laser driver that receives input of an L level IC select signal executes APC on the light-emitting portion that is the control target.

Signal lines 408 and 409 are signal lines connecting the CPU 401 and the laser drivers 405A and 405B. The signal lines 407A, 407B, 408, and 409 are interfaces for transmitting later-described control mode signals that set control modes of the laser drivers 405A and 405B. The laser drivers 405A and 405B execute various types of control based on the control mode signals transmitted from the CPU 401.

Information regarding a later-described APC sequence is stored in the EEPROM 410. The CPU 401 executes light power control on the light-emitting portions in a sequence based on the information regarding the APC sequence stored in the EEPROM 410.

Control Modes

DIS Mode (Disable Mode)

DIS mode is set to an initial state immediately after the power supply of the image forming apparatus 100 is switched on. Also, the DIS mode is set for interlocking in a state in which a maintenance door is open for maintenance of the image forming apparatus. The DIS mode is a state in which charge is discharged from a later-described hold capacitor and laser beams are not emitted from the light-emitting portions.

OFF Mode

OFF mode is a mode that is set in a period (non-image-forming period) other than a period in which the laser beams scan the image forming region on the photosensitive drum during image formation (image forming period), and is set in a state in which the laser drivers 405A and 405B wait for input of the LVDS. The OFF mode is a mode in which the bias current Ib is supplied to the light-emitting portions and the switching current Isw is not supplied thereto.

ACC (Automatic Current Control) Mode

ACC mode is a mode in which the light-emitting portions are mandatorily turned on. The ACC mode in the image forming apparatus 100 of the present embodiment is used for causing the BD sensor 210 to generate the second BD signal when later-described BD interval measurement is to be executed in a non-image-forming period.

VDO Mode

VDO mode (VIDEO mode) is a mode set in an image forming period. It is a mode in which the bias current Ib is supplied to the light-emitting portions and the switching current Isw is controlled so as to switch on and off based on the PWM signals that are generated based on the LVDS input to the laser drivers 405A and 405B.

APC Mode

APC mode is a mode in which APC is executed. The value of the bias current Ib is controlled based on the results of the later-described first light power control and the second light power control in APC, and the value of the switching current Isw is controlled based on the result of the later-described third light power control. The APC mode is a mode that is set in a non-image-forming period, for executing the first light power control, the second light power control, and the third light power control in a period when OFF mode is not set.

APC

Next, APC that is executed in the image forming apparatus 100 of the present embodiment will be described in detail.

Figure 5:
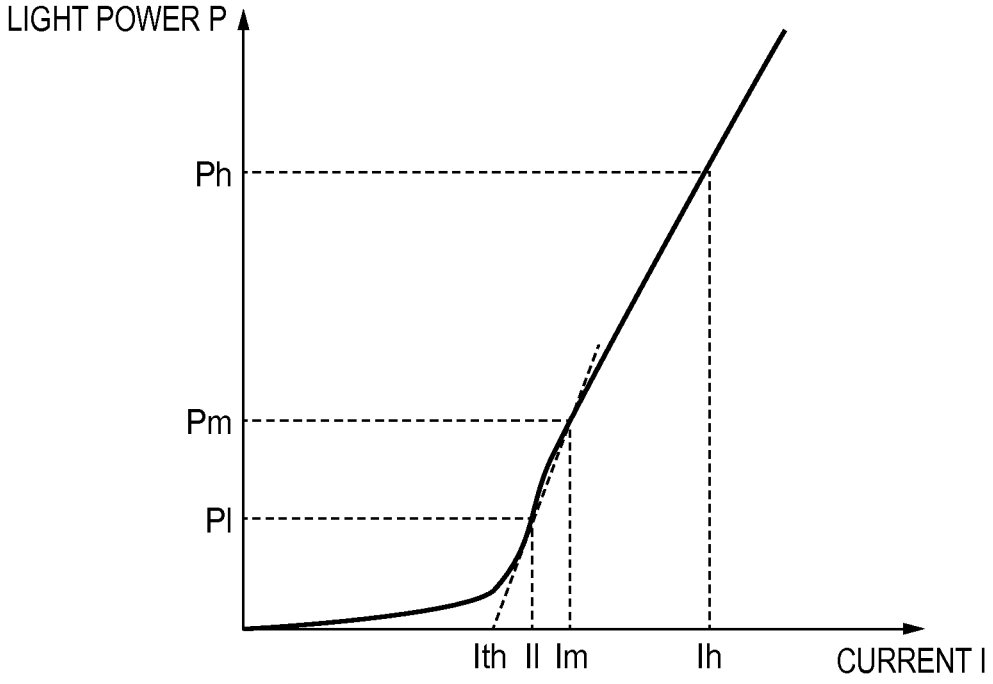
FIG. 5 shows a light emission property of a light-emitting portion in a semiconductor laser.

First, the bias current Ib and the switching current Isw will be described. FIG. 5 is a diagram showing a light emitting property of a light-emitting portion in the semiconductor laser 200, where the horizontal axis indicates the value of the current supplied to the light-emitting portion and the vertical axis indicates the light power of the laser beams emitted from the light-emitting portion. The curved line shown in FIG. 5 shows a light emission property representing the relationship between the value of the current supplied to the light-emitting portions and the light power of the laser beams. Note that the light emission property is a property unique to the light-emitting portions that changes due to the temperature of the light-emitting portion and changes over time. For this reason, an electrophotographic image forming apparatus needs to execute APC at a high frequency for each light-emitting portion in order to suppress the occurrence of image density unevenness that accompanies variation in the light emission property.

As shown in FIG. 5, in general, the property of the semiconductor laser is such that the light power of the laser beam increases more slowly than the current value increases in the region where the value of the current supplied to the light-emitting portion is lower than a threshold current Ith, whereas the amount by which the light power of the laser beam increases with respect to an increase in the current value increases in the region where the value of the current is greater than the threshold current Ith. When a current that is not greater than the threshold current Ith is supplied, the semiconductor laser performs spontaneous light emission without stimulated oscillation. Light power resulting from spontaneous light emission is minute, and therefore the potential of the photosensitive drum is not displaced if spontaneous light emission is performed.

Utilizing this property of the semiconductor laser, with the electrophotographic image forming apparatus, a bias current Ib with a value close to that of the threshold current Ith is supplied to the light-emitting portion in order to suppress a reduction in light emission responsiveness. When the bias current Ib is supplied, the switching current Isw is supplied based on the PWM signal generated based on the LVDS, and thereby a laser beam with an intensity that causes the potential of the photosensitive drum surface to change is emitted from the light-emitting portion. By turning on the light-emitting portion in a state in which the bias current Ib is supplied thereto, it is possible to shorten the time for reaching the target light power of the laser beam, to a greater extent than that in the case of turning on the light-emitting portion in a state in which the bias current Ib is not supplied.

Next, control of the value of the bias current Ib in the image forming apparatus 100 of the present embodiment will be described. The laser drivers 405A and 405B execute the first and second light power control respectively at different times on the light-emitting portions 301 to 332. Here, first and second light power control will be described using the laser driver 405A and the light-emitting portion 301.

As described above, the laser driver 405A executes the first light power control, according to which the value of the current supplied to the light-emitting portion 301 is controlled such that the light power received by the PD 204 is Pm. The laser driver 405A stores the current value Im corresponding to the light power Pm as the control result of the first light power control.

Also, the laser driver 405A executes the second light power control, according to which the value of the current supplied to the light-emitting portion 301 is controlled such that the light power received by the PD 204 is Pl (Pl=Pm/2). The laser driver 405A stores the current value Il corresponding to the light power Pl as the control result of the second light power control.

Note that when the laser driver 405A is to perform the first light power control and the second light power control on the light-emitting portion 301, the laser driver 405A supplies only bias currents Ib with values corresponding to the light-emitting portions to the light-emitting portions 302 to 316 (OFF mode). Also, the laser driver 405B supplies only bias currents Ib with values corresponding to the light-emitting portions to the light-emitting portions 317 to 332 similarly as well (OFF mode).

The laser driver 405A uses calculation to obtain the point of intersection between a line segment connecting (Im, Pm) and (Il, Pl) in FIG. 5 (correspondence relationship) and the axis at which the light power is 0, and sets the value of the point of intersection as the threshold current Ith. Then, the laser driver 405A updates (re-sets) the value of the bias current Ib by multiplying the threshold current Ith by a predetermined coefficient $\alpha$. Note that the coefficient $\alpha$ is set in advance according to the sensitivity of the photosensitive drum attached to the image forming apparatus, and it may be a value that is greater than or equal to 1, or a value that is less than 1.

Next, control of the value of the switching current Isw in the image forming apparatus 100 of the present embodiment will be described. In addition to the first light power control and the second light power control, the laser driver 405A executes a third light power control, according to which the value of the current supplied to the light-emitting portion 301 is controlled such that the light power received by the PD 204 is Ph (Ph=Pm×2). The laser driver 405A stores the current value Ih corresponding to the light power Ph as the control result of the third light power control. The value of the switching current Isw is a value obtained by subtracting the value of the bias current Ib from a value obtained by multiplying the current value Ih by a coefficient 13, which is set based on the conditions of the image forming apparatus 100 (Isw=βIh−Ib).

Laser Driver

Next, the configuration of the laser drivers 405A and 405B for executing the above-described first light power control, second light power control, and third light power control in APC will be described.

Figure 6:
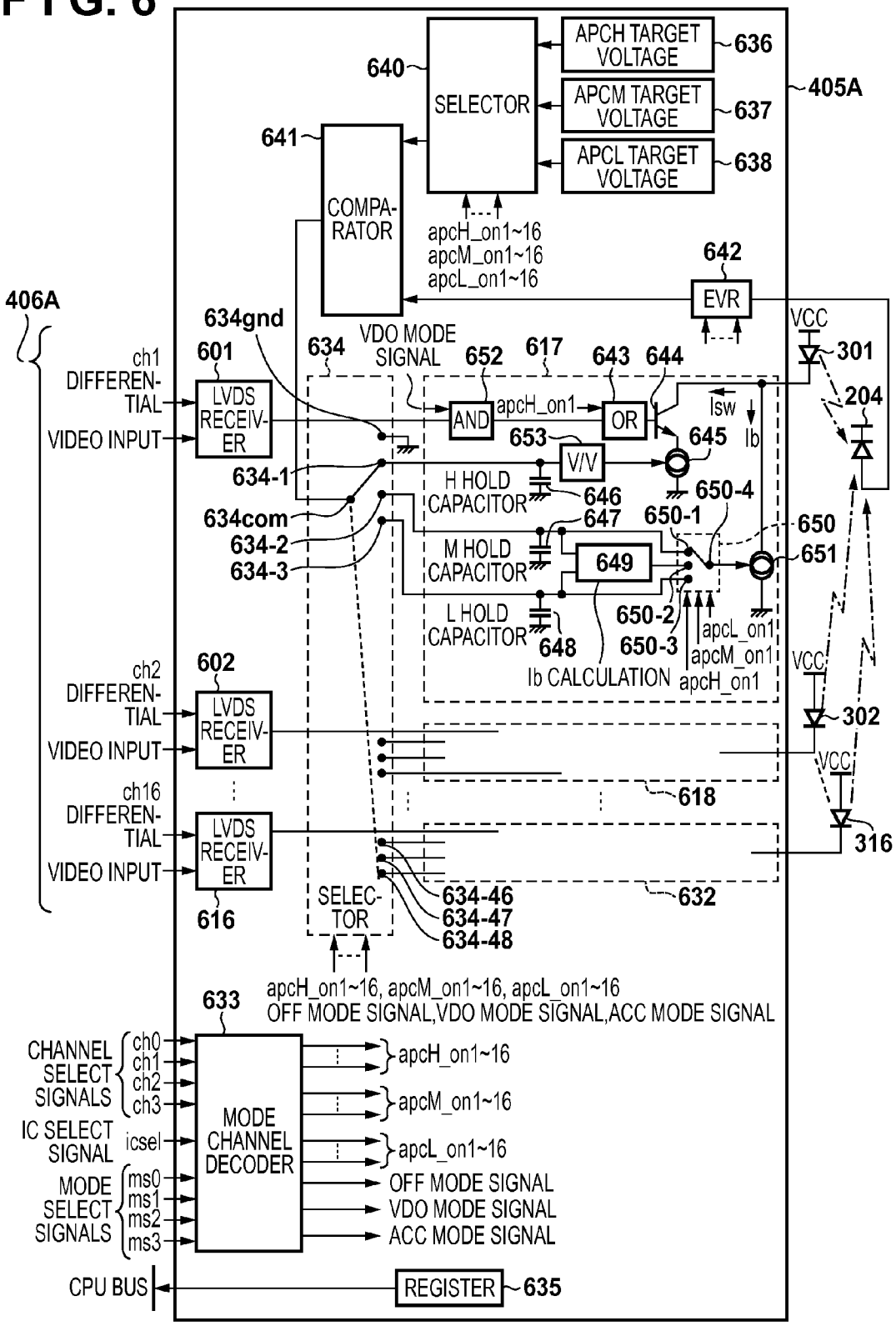
FIG. 6 is a diagram showing an overall configuration of a laser driver.

FIG. 6 is a diagram showing the internal configuration of the laser driver 405A. Since the internal configuration of the laser driver 405B is the same as the internal configuration of the laser driver 405A, the description for the laser driver 405B will not be included.

The laser driver 405A includes a mode channel decoder 633. Also, the laser driver 405A includes LVDS receivers 601 to 616 and driving units 617 to 632 (which each include an AND circuit 652, an OR circuit 643, a transistor 644, and a switching current source 645), which correspond to the light-emitting portions 301 to 316. Also, the laser driver 405A includes a first voltage output unit 636 that outputs a target voltage Vm (comparison signal) corresponding to the first light power (Pm) to the light-emitting portions 301 to 316, a second voltage output unit 637 that outputs a target voltage Vl (comparison signal) corresponding to the second light power (Pl) to the light-emitting portions 301 to 316, and a third voltage output unit 638 that outputs a target voltage Vh (comparison signal) corresponding to the third light power Ph to the light-emitting portions 301 to 316. Furthermore, the laser driver 405A includes a selector 640, a comparator 641, an EVR 642, the mode channel decoder 633, a selector 634, and a register 635.

First, the mode channel decoder 633 will be described. The mode channel decoder 633 has a function of switching the control mode of the laser driver 405A to the DIS mode, the VDO mode, the OFF mode, the ACC mode, and the APC mode based on the mode select signal, the channel select signal, and the IC select signal from the CPU 401.

The CPU 401 outputs the IC select signal (icsel_0) to the mode channel decoder 633. The mode channel decoder 633 controls the laser driver 405A so as to be in the APC mode, based on the IC select signal from the CPU 401. Note that if the laser driver 405A is not in the APC mode at the time when APC is to be executed, the mode channel decoder provided in the laser driver 405B controls the laser driver 405B so as to be in the APC mode based on the IC select signal from the CPU 401. That is to say, at the time at which APC is to be executed, the IC select signal is used to select one of the laser driver 405A and the laser driver 405B to transition to the APC mode.

The CPU 401 outputs a group of mode select signals (ms0, ms1, ms2, ms3) and a group of channel select signals (ch0, ch1, ch2, ch3) to the mode channel decoder 633. The mode channel decoder 633 generates an APC mode signal (apcH_on1 to 16, apcM_on1 to 16, apcL_on1 to 16) based on the group of mode select signals and the group of channel select signals from the CPU 401.

The mode channel decoder 633 outputs the APC mode signals to the laser driver 405A, which is in the APC mode. The APC mode signal apcH_on is a signal that causes the laser driver 405A to execute the third light power control. The APC mode signal apcM_on is a signal that causes the laser driver 405A to execute the first light power control. The APC mode signal apcL_on is a signal that causes the laser driver 405A to execute the second light power control.

The mode channel decoder 633 outputs the APC mode signals apcH_on, apcM_on, and apcL_on to the light-emitting portions 301 to 316 at different times (i.e., sets them to the H level, which indicates that APC is to be performed). That is to say, the mode channel decoder 633 generates a total of 48 APC mode signals, namely the APC mode signals apcH_on1 to 16, apcM_on1 to 16, and apcL_on1 to 16, and one of the signals among the 48 APC mode signals is set to the H level. The laser drivers 405A and 405B execute light power control on the light-emitting portions corresponding to the APC mode signals output by the mode channel decoder 633 included in each one.

FIG. 7A is a table showing mode select signals, channel select signals, and IC select signals corresponding to various types of control modes, which are output by the CPU 401. In FIG. 7A, "DIS" indicates the DIS mode, and "ACC" indicates the ACC mode. Also, "VDO" indicates the VDO mode, and "OFF" indicates the OFF mode. "APCH", "APCM", and "APCL" indicate the third, first, and second light power control respectively.

"ic" indicates the IC select signals icsel_0 and icsel_1. If the mode select signal that is input indicates execution of APC and the IC select signal is in the L level, the laser drivers 405A and 405B enter a state in which it is possible to execute the first, second, and third light power control.

The control modes are controlled according to the combination of mode select signals (ms0, ms1, ms2, ms3) shown in FIG. 7A. Note that the number [1] in the table indicates all combinations other than the combinations of mode select signals for the DIS mode, the ACC mode, the APCH mode, the APCM mode, and the APCL mode. The number [2] in the table means that the control state is determined independently of the IC select signals and the channel select signals (ch0, ch1, ch2, and ch3). The symbol [*] in the table indicates a combination of channel select signals (ch0, ch1, ch2, ch3) shown in FIG. 7B. Reference numerals e1 to e16 in FIG. 7B correspond respectively to the light-emitting portions 301 to 316.

Here, an example of a table referencing method will be indicated. For example, a case is envisioned in which the combination of mode select signals (ms3, ms2, ms1, ms0) output by the CPU 401 is (L, L, H, L), and the combination of channel select signals (ch0, ch1, ch2, ch3) is (L, H, L, L). In this case, the laser drivers 405A and 405B will execute the first light power control (APCM) on the light-emitting portion 305 corresponding to e5. Among the 48 APC mode signals, the mode channel decoder 633 sets only the APC mode signal apcM_on5 corresponding to the light-emitting portion 305 to the H level based on the mode select signal and the channel select signal and sets the other APC mode signals to the L level.

Next, the driving units 617 to 632 will be described. The driving units 617 to 632 are provided in correspondence with the respective light-emitting portions 301 to 316 and supply driving currents to the corresponding light-emitting portions. The driving units 617 to 632 each have the same configuration, and therefore the internal configurations thereof will be described taking the driving unit 617 as an example.

The driving unit 617 includes an M hold capacitor 647, an L hold capacitor 648, an Ib calculation unit 649, a selector 650, and a bias current source 651. The driving unit 617 furthermore includes an AND circuit 652, an OR circuit 643, a transistor 644, a switching current source 645, an H hold capacitor 646, and a voltage adjustment circuit (V/V) 653.

As shown in FIG. 6, the bias current source 651 and the switching current source 645 are connected to the light-emitting portion 301. The bias current source 651 and the switching current source 645 are drawing current sources that each draw the bias current Ib and the switching current Isw from VCC. In the VDO mode, the OFF mode, the ACC mode, and the APC mode, the bias current Ib is supplied to the light-emitting portion 301 by the bias current source 651.

The Ib calculation unit 649 is connected to the M hold capacitor 647 and the L hold capacitor 648. As will be described later, the Ib calculation unit 649 calculates the value of the bias current Ib based on the control result of the first light power control (voltage of the M hold capacitor 647) and the control result of the second light power control (voltage of the L hold capacitor 648).

Next, the LVDS receivers 601 to 616, and the AND circuit 652, the OR circuit 643, the transistor 644, and the switching current source 645 that are included in the driving unit 617 will be described. The LVDS receivers 601 to 616 each have the same configuration, and therefore a description will be given taking the LVDS receiver 601 as an example. The LVDS receiver 601 receives a differential signal, which is image data, from the CPU 401. The LVDS receiver 601 outputs the PWM signal to the AND circuit 652 based on the differential signal.

The AND circuit 652 has two terminals, and the PWM signal from the LVDS receiver 601 is input to one terminal, and the mode signal (VDO mode signal) from the mode channel decoder 633 is input to the other terminal. If the VDO mode signal input to the AND circuit 652 is at the H level and the PWM signal is at the H level, the AND circuit 652 outputs an H level signal. If at least one of the VDO mode signal and the PWM signal input to the AND circuit 652 is at the L level, the AND circuit 652 outputs an L level signal.

The OR circuit 643 has two terminals, and the signal output from the AND circuit 652 is input to one terminal, and the APC mode signal (apcH_on1) from the mode channel decoder 633 is input to the other terminal. If at least one of the signal output from the AND circuit 652 and apcH_on1 is at the H level, the OR circuit 643 outputs an H level signal, and if both the signal output from the AND circuit 652 and apcH_on1 are at the L level, the OR circuit 643 outputs an L level signal.

The output of the OR circuit 643 is connected to the base terminal of the transistor 644. The collector terminal of the transistor 644 is connected to the light-emitting portion 301 and the emitter terminal of the transistor 644 is connected to the switching current source 645. When an H level signal is output from the OR circuit 643, the region between the collector terminal and the emitter terminal of the transistor 644 enters a state of being conductive, and the switching current source 645 draws the switching current Isw from VCC. Accordingly, the switching current Isw for emitting the laser beams is supplied to the light-emitting portion 301. Note that when an L level signal is output from the OR circuit 643, the region between the collector terminal and the emitter terminal of the transistor 644 enters a state of being non-conductive.

The selector 640 selects one of the output signal Vh of an APCH target voltage output unit 636, the output signal Vm of an APCM target voltage output unit 637, and the output signal Vl of the APCL target voltage output unit 638. By performing selection based on the APC mode signals (apcH_on1 to 16, apcM_on1 to 16, and apcL_on1 to 16), which are output from the mode channel decoder 633, the selector 640 outputs the output signal Vh, Vm, or Vl to the comparator 641. Note that the output signals Vh, Vm, and Vl are voltages that correspond to the third, first, and second light powers (target light powers) Ph, Pm, and Pl respectively.

The selector 634 includes a terminal 634*com* that is connected to the comparator 641, a terminal 634*gnd* that is grounded, and terminals 634-1 to 634-48. As shown in FIG. 6, the terminal 634-1 is connected to the H hold capacitor 646 of the driving unit 617. Also, the terminal 634-2 is connected to the M hold capacitor 647 of the driving unit 617. Furthermore, the terminal 634-3 is connected to the L hold capacitor 648 of the driving unit 617. The other terminals 634-4 to 48 are also similarly connected to the H hold capacitors, M hold capacitors, or L hold capacitors of the driving units.

The APC mode signals (apcH_on1 to 16, apcM_on1 to 16, apcL_on1 to 16), the OFF mode signal, the VDO mode signal, and the ACC mode signal are selectively input from the mode channel decoder 633 to the selector 634. If the VDO mode signal, the OFF mode signal, and the ACC mode signal are input, the selector 634 connects the terminal 634*com* and the terminal 634*gnd*. Accordingly, the driving unit 617 enters a state in which charging and discharging of the H hold capacitor 646, the M hold capacitor 647, and the L hold capacitor 648 are not performed. On the other hand, if the APC mode signals (apcH_on1 to 16, apcM_on1 to 16, apcL_on1 to 16) are input, the selector 634 connects the terminal 634*com* and the terminal among the terminals 634-1 to 634-48 that corresponds to the H level APC mode signal.

The selector 650 provided in the driving unit 617 receives input of the APC mode signals (apcH_on1, apcM_on1, apcL_on1), the VDO signals, the OFF mode signals, and the ACC mode signals from the mode channel decoder 633. The selector 650 of the driving units 618 to 632 also receives input of the corresponding signals. The selector 650 includes a terminal 650-1 that is connected to the M hold capacitor 647, a terminal 650-2 that is connected to the Ib calculation unit 649, a terminal 650-3 that is connected to the L hold capacitor 648, and a terminal 650-4 that is connected to the bias current source 651.

If input of the APC mode signal apcH_on1, the VDO mode signal, the OFF mode signal, and the ACC mode signal is received, the selector 650 connects the terminal 650-2 and the terminal 650-4. If input of apcM_on1 is received, the selector 650 connects the terminal 650-1 and the terminal 650-4. If input of apcL_on1 is received, the selector 650 connects the terminal 650-3 and the terminal 650-4.

An EVR 642 receives input of the detection signal from the PD 204. The EVR 642 has a function of correcting the detection signal so as to be a value corresponding to the light source based on a light power adjustment table. It is input to the EVR 642. The EVR 642 receives input of apcH_on1 to 16, apcM_on1 to 16, and apcL_on1 to 16.

Scale adjustment coefficients corresponding to the optical condensing efficiency of the PD sensor and the laser elements are measured in advance at the factory and set in the register 635 in a step of APC preparation, and thus are prepared as pieces of table data in the EVR 642. With the EVR 642, a table is selected according to the APC mode signal (apcH_on1 to 16, apcM_on1 to 16, and apcL_on1 to 16).

First Light Power Control (APCM)

The CPU 401 controls the mode select signals and the channel select signals in order to execute the first light power control (APCM), according to which the voltage of the M hold capacitor 647 is controlled. The mode channel decoder 633 outputs the APC mode signal apcM_on1 for executing the first light power control on the light-emitting portion 301 to the selector 634, the selector 640, and the selector 650 based on the mode select signals and the channel select signals from the CPU 401.

In response to receiving input of the APC mode signal apcM_on1, the selector 634 connects the terminal 634*com* and the terminal 634-2. In response to receiving input of the APC mode signal apcM_on1, the selector 640 selects the comparison signal Vm output from the target voltage output unit 637 and inputs it to the comparator 641. In response to receiving input of the APC mode signal apcM_on1, the selector 650 connects the terminals 650-1 and 650-4.

When the selector 650 connects the terminals 650-1 and 650-4, the bias current source 651 draws a current with a value based on the voltage of the M hold capacitor 647 from VCC. The light-emitting portion 301 emits a laser beam according to the current. The laser beam emitted from the light-emitting portion 301 is incident on the PD 204, and the PD 204 outputs a detection signal corresponding to the light power of the laser beam.

The comparator 641 compares a comparison signal Vm from the selector 640, which is a voltage corresponding to the first light power (target light power) Pm, and an amplification signal Samp (Vamp) from the amplification circuit 642, and outputs a signal based on the comparison result to the selector 634. Specifically, if Vamp>Vm, the light power of the laser beam incident on the PD 204 is greater than the first light power Pm, and therefore the comparator 641 discharges the M hold capacitor 647. When the discharging of the M hold capacitor 647 is continued, the light power of the laser beam incident on the PD 204 decreases and approaches the first light power Pm. In response to Vamp becoming equal (or approximately equal) to Vm, the comparator 204 holds the voltage of the M hold capacitor 647.

On the other hand, if Vamp<Vm, the light power of the laser beam incident on the PD 204 is less than the first light power (target light power) Pm, and therefore the comparator 641 charges the M hold capacitor 647. When the M hold capacitor 647 continues to be charged, the light power of the laser beam incident on the PD 204 increases and approaches the first light power Pm. In response to Vamp becoming equal (or approximately equal) to Vm, the comparator 204 holds the voltage of the M hold capacitor 647.

If Vamp=Vm, the light power of the laser beam incident on the PD 204 is the first light power (target light power) Pm, and therefore the comparator 641 holds the voltage of the M hold capacitor 647 in that state.

Thus, with the first light power control (APCM) in APC, the voltage of the M hold capacitor 647 is controlled so that the light power of the laser beam that is emitted from the light-emitting portion 301 and is incident on the PD 204 is controlled so as to be the first light power (target light power).

Second Light Power Control (APCL)

Next, the CPU 401 controls the mode select signals in order to execute the second light power control (APCL), in which the voltage of the L hold capacitor 648 is controlled. The mode channel decoder 633 outputs the APC mode signal apcL_on1 for executing the second light power control on the light-emitting portion 301 to the selector 634, the selector 640, and the selector 650 based on the mode select signals from the CPU 401.

The selector 634 connects the terminal 634*com* and the terminal 634-3 in response to receiving input of the APC mode signal apcL_on1. In response to receiving input of the APC mode signal apcL_on1, the selector 640 selects the comparison signal Vl output from the target voltage output unit 638 and inputs it to the comparator 641. In response to receiving input of the APC mode signal apcL_on1, the selector 650 connects the terminals 650-3 and 650-4.

When the selector 650 connects the terminals 650-3 and 650-4, the bias current source 651 draws a current with a value based on the voltage of the L hold capacitor 648 from the VCC. The light-emitting portion 301 emits a laser beam according to the current. The laser beam emitted from the light-emitting portion 301 is incident on the PD 204, and the PD 204 outputs a detection signal corresponding to the light power of the laser beam.

The comparator 641 compares a comparison signal Vl from the selector 640, which is a voltage corresponding to the second light power (target light power) Pl, and an amplification signal Samp (Vamp) from the amplification circuit 642, and outputs a signal based on the comparison result to the selector 634. Specifically, if Vamp>Vl, the light power of the laser beam incident on the PD 204 is greater than the second light power Pl, and therefore the comparator 641 discharges the L hold capacitor 648. When the discharging of the L hold capacitor 648 is continued, the light power of the laser beam incident on the PD 204 decreases and approaches the second light power Pl. In response to Vamp becoming equal (or approximately equal) to Vl, the comparator 204 holds the voltage of the L hold capacitor 648.

On the other hand, if Vamp<Vl, the light power of the laser beam incident on the PD 204 is less than the second light power (target light power) Pl, and therefore the comparator 641 charges the L hold capacitor 648. When the charging of the L hold capacitor 648 is continued, the light power of the laser beam incident on the PD 204 increases and approaches the second light power Pl. In response to Vamp becoming equal (or approximately equal) to Vl, the comparator 204 holds the voltage of the L hold capacitor 648.

If Vamp=Vl, the light power of the laser beam incident on the PD 204 is the second light power (target light power) Pl, and therefore the comparator 641 holds the voltage of the L hold capacitor 648 in that state.

Thus, with the second light power control (APCL) in APC, the voltage of the L hold capacitor 648 is controlled so that the light power of the laser beam that is emitted from the light-emitting portion 301 and is incident on the PD 204 is controlled so as to be the second light power (target light power) Pl.

Calculation of Bias Current

In response to the above-described first light power control (APCM) and second light power control (APCL) being completed, the Ib calculation unit 649 (bias current control unit) calculates the value of the bias current Ib based on the control result of the first light power control and the control result of the second light power control. That is to say, the Ib calculation unit 649 uses the above-described calculation method to calculate the value of the bias current Ib based on the voltage of the M hold capacitor 647 and the voltage of the L hold capacitor 648.

If the first light power control and the second light power control for the light-emitting portion 301 have not been performed, the selector 650 connects the terminal 650-2 and the terminal 650-4. By connecting the terminal 650-2 and the terminal 650-4, the Ib calculation unit 649 calculates the value of the bias current Ib and outputs the control signal, which is the calculation result, to the bias current source 651. The bias current source 651 draws a bias current with a value based on the control signal from the Ib calculation unit 649 from the VCC. The value of the bias current is controlled similarly for the other light-emitting portions 302 to 332 as well.

Third Light Power Control (APCH)

The value of the switching current Isw is defined by the voltage of the H hold capacitor 646. In order to control the value of the switching current Isw, the CPU 401 executes the third light power control (APCH), in which the voltage of the H hold capacitor 646 is controlled. The third light power control is executed on the light-emitting portion 301 in a state in which the bias current Ib is supplied to the light-emitting portion 301.

The CPU 401 controls the mode select signals in order to execute the third light power control (APCH), in which the voltage of the H hold capacitor 646 is controlled. The mode channel decoder 633 outputs the APC mode signal apcH_on1 for executing the third light power control on the light-emitting portion 301 to the selector 634, the selector 640, the selector 650, and the OR circuit 643 based on the mode select signals from the CPU 401.

The selector 634 connects the terminal 634*com* and the terminal 634-1 in response to receiving input of the APC mode signal apcH_on1. In response to receiving input of the APC mode signal apcH_on1, the selector 640 selects the comparison signal Vh output from the target voltage output unit 636 and inputs it to the comparator 641. In response to receiving input of the APC mode signal apcH_on1, the selector 650 connects the terminals 650-2 and 650-4.

The bias current Ib is supplied to the light-emitting portion 301 due to the terminals 650-2 and 650-4 of the selector 650 being connected. In response to the APC mode signal apcH_on1 being input to the OR circuit 643, the transistor 644 enters a conductive state, and the switching current source 645 supplies the current to the light-emitting portion 301. The light-emitting portion 301 emits a laser beam due to the current being supplied thereto from the switching current source 645 in a state in which the bias current Ib is supplied thereto. The laser beam emitted from the light-emitting portion 301 is incident on the PD 204, and the PD 204 outputs a detection signal corresponding to the light power of the laser beam.

The comparator 641 compares a comparison signal Vh from the selector 640, which is a voltage corresponding to the third light power (target light power) Ph, and an amplification signal Samp (Vamp) from the amplification circuit 642, and outputs a signal based on the comparison result to the selector 634. Specifically, if Vamp>Vh, the light power of the laser beam incident on the PD 204 is greater than the third light power Ph, and therefore the comparator 641 discharges the H hold capacitor 646. When the discharging of the H hold capacitor 646 is continued, the light power of the laser beam incident on the PD 204 decreases and approaches the third light power Ph. In response to Vamp becoming equal (or approximately equal) to Vh, the comparator 204 holds the voltage of the H hold capacitor 646.

On the other hand, if Vamp<Vh, the light power of the laser beam incident on the PD 204 is less than the third light power (target light power) Ph, and therefore the comparator 641 charges the H hold capacitor 646. When the charging of the H hold capacitor 646 is continued, the light power of the laser beam incident on the PD 204 increases and approaches the third light power Ph. In response to Vamp becoming equal (or approximately equal) to Vh, the comparator 204 holds the voltage of the H hold capacitor 646.

If Vamp=Vh, the light power of the laser beam incident on the PD 204 is the third light power (target light power) Ph, and therefore the comparator 641 holds the voltage of the H hold capacitor 646 in that state.

Thus, with the third light power control (APCH) in APC, the voltage of the H hold capacitor 646 is controlled so that the light power of the laser beam that is emitted from the light-emitting portion 301 and is incident on the PD 204 is controlled so as to be the third light power (target light power) Ph.

As shown in FIG. 6, the voltage adjustment circuit 653 is connected between the H hold capacitor 646 and the switching current source 645. The voltage adjustment circuit 653 receives input of a voltage control signal (not shown) from the CPU 401. The voltage control signal is a signal for adjusting the voltage of the H hold capacitor 646. The CPU 401 generates the voltage control signal based on the state of the image forming apparatus 100 (e.g., sensitivity of the photosensitive drum 102 with respect to laser beams, toner charge state, temperature of apparatus interior) and the state of the environment in which the image forming apparatus 100 has been placed (temperature, humidity). The switching current source 645 supplies the switching current Isw with a value based on the voltage adjusted by the voltage adjustment circuit 653 to the light-emitting portion 301.

Note that the voltage adjustment circuit 653 can receive input of the APC mode signal apcH_on1 and the VDO mode signal as well, and if apcH_on1 is input, the voltage adjustment circuit 653 does not perform voltage adjustment on the H hold capacitor 646 using the voltage control signal.

Note that in the present embodiment, the second light power Pl<the first light power Pm<the third light power Ph, but the relative magnitude relationship of the light powers is not limited to this.

APC Mode and ACC Mode

Figure 8A:
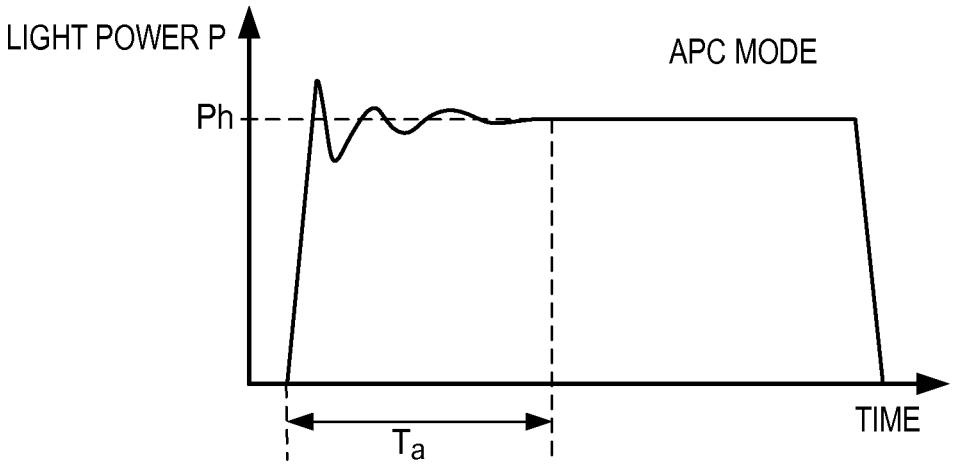
FIGS. 8A and 8B are diagrams showing an example of change over time in the light power of laser beams emitted by the light-emitting portions, the change being caused by light power control in an APC mode and an ACC mode used in measurement of a time interval between BD signals.
Figure 8B:
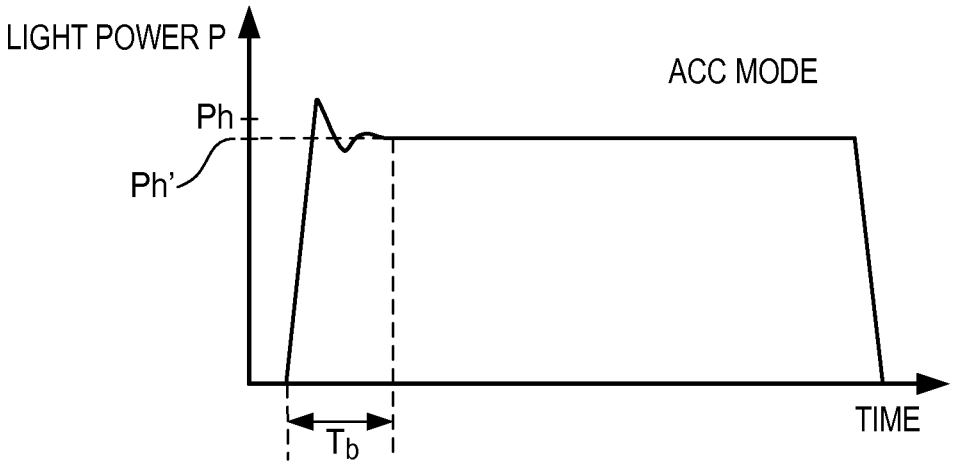

Next, the APC mode and the ACC mode used in measuring a later-described time interval between two BD signals in the image forming apparatus 100 (optical scanning apparatus 104) of the present embodiment will be described with reference to FIGS. 8A and 8B. FIGS. 8A and 8B are diagrams showing an example of change over time in the light power P of a laser beam emitted from a light-emitting portion (one of the light-emitting portions 301 to 332) in the case where light power control is performed on the light-emitting portion in the above-mentioned APC mode and the ACC mode. FIG. 8A shows change over time in the light power of a laser beam emitted from a light-emitting portion in the case where the above-described third light power control (APCH), in which the third light power Ph is used as the target light power, is executed as APC. Also, FIG. 8B shows change over time in the light power of a laser beam emitted from a light-emitting portion in the case where the light-emitting portion is caused to emit light in the ACC mode upon the elapse of a certain time since executing APC (third light power control).

As shown in FIG. 8A, the light power P of the laser beam emitted from the light-emitting portion set to the APC mode is controlled so as to be the target light power Ph with the execution of APC. In the APC mode, the H hold capacitor 646 is repetitively charged and discharged, and therefore the light power P is unstable for a short time ($T_a$) after the light-emitting portion starts to emit light. When the voltage of the H hold capacitor 646 converges at the voltage corresponding to the target light power Ph, the light power P enters a state of being stable at the target light power Ph. The time $T_a$ is defined according to the capacity and the like of the H hold capacitor 646, and is generally around several μs long. The target light power Ph is set to a certain value, and as described above, in the present embodiment, the value of the target light power Ph is 0.2 mW. Also, it is assumed that the state of being stable at the target light power Ph is a state in which a light power variation of ±0.5% from 0.2 mW is indicated. Note that the value of the target light power Ph and the parameters indicating the state of being stable at the target light power Ph are not limited to the description above, and are values determined by the design specifications and the like of the semiconductor laser 200 and the image forming apparatus 100.

On the other hand, light power control (ACC) is executed on the light-emitting portion set to the ACC mode by supplying a driving current based on the voltage of the H hold capacitor 646, which is in a state of being held, to the light-emitting portion. If the H hold capacitor 646 is in a state of being charged, as shown in FIG. 8B, the light power of the laser beam emitted by the light-emitting portion set to the ACC mode rapidly changes to the light power corresponding to the voltage of the H hold capacitor 646. In FIG. 8B, ACC is executed such that upon the elapse of a time $T_b$ since the light-emitting portion started emitting light, the light power P enters a state of being stable at a light power Ph'. The light power Ph' corresponds to the voltage of the H hold capacitor 646. The voltage of the H hold capacitor 646 decreases with the elapse of time due to the charge being discharged from the capacitor, and as a result, the light power Ph' falls from the target light power Ph with the elapse of time. However, as can be understood from FIGS. 8A and 8B, in the case of the ACC mode, it is possible to cause the light power P of the laser beam emitted from the light-emitting portion to converge (be stable) at a constant light power in a time shorter than that in the case of the APC mode ($T_b<T_a$).

BD Interval Measurement

With the image forming apparatus 100, due to the configuration of the light source (semiconductor laser 200) such as that shown in FIG. 3A, the laser beams emitted from the light-emitting portions form images at the different positions $S_1$ to $S_{32}$ in the main scanning direction on the photosensitive drum 102, as shown in FIG. 3B. In this case, in order to align the writing start positions in the main scanning direction for the electrostatic latent image (image) that is to be formed by laser beams emitted from the light-emitting portions, the timings according to which the laser beams are emitted need to be appropriately controlled for each light-emitting portion.

With the image forming apparatus 100 of the present embodiment, the CPU 401 controls the semiconductor laser 200 such that laser beams from two light-emitting portions (first and second light-emitting portions) among N light-emitting portions (N=32 in the present embodiment) are incident on the BD sensor 210 in sequence. Furthermore, the CPU 401 measures the time interval (also referred to as "BD interval" in the present specification) between two BD signals (first and second detection signals) generated in sequence by the BD sensor 210 (BD interval measurement). The image forming apparatus 100 performs the BD interval measurement in a non-image-forming period during which image formation on a recording medium is not performed. Furthermore, in an image forming period during which image formation is performed, using a single BD signal generated in each laser beam scanning cycle as a reference, the image forming apparatus 100 controls the relative timings according to which the light-emitting portions emit the laser beams based on image data, based on the measurement value obtained using BD interval measurement.

With BD interval measurement, in order to reduce measurement error, the light power when the laser beams from the first and second light-emitting portions used in measurement are incident on the BD sensor 210 needs to be made constant, as described above. The light power of the laser beams incident on the BD sensor 210 can be controlled so as to be a constant light power (target light power) according to APC, as described above. However, due to the execution of APC, several μs of time are needed from when the light-emitting portions start emitting light to when the light-emitting portions enter a state of being stable at the target light power (Ph in FIG. 8A). For this reason, as will be described below, if sufficient time for executing APC on the light-emitting portions used in measurement cannot be reserved, the light power of the laser beams emitted by the light-emitting portions cannot be stabilized at a constant light power, and the accuracy of BD interval measurement can decrease.

Figure 9A:
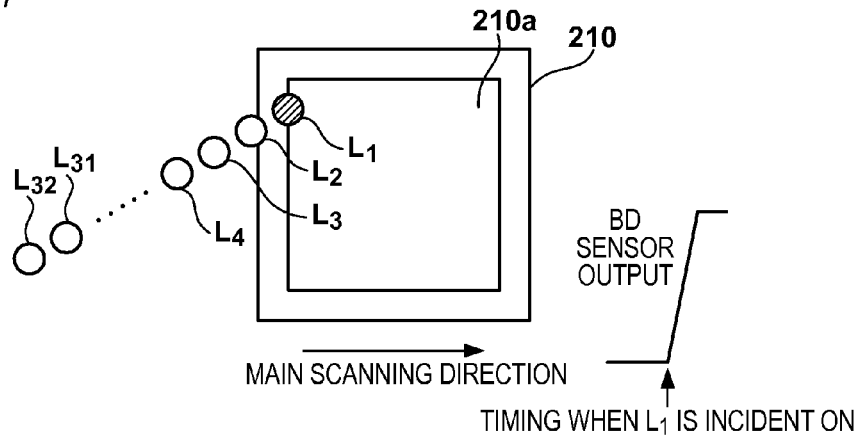
FIGS. 9A to 9C are diagrams showing an example of a relationship between output from a BD sensor and a state in which laser beams $L_1$ to $L_{32}$ emitted from the light-emitting portions scan a light-receiving surface of the BD sensor.
Figure 9B:
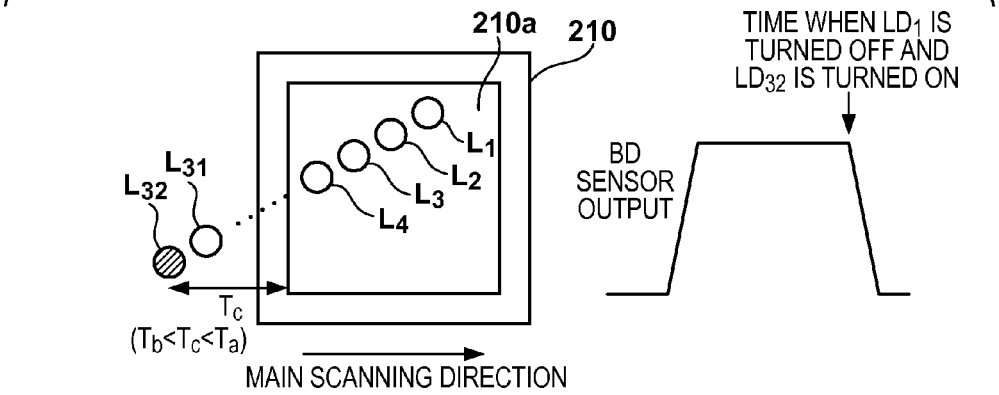
Figure 9C:
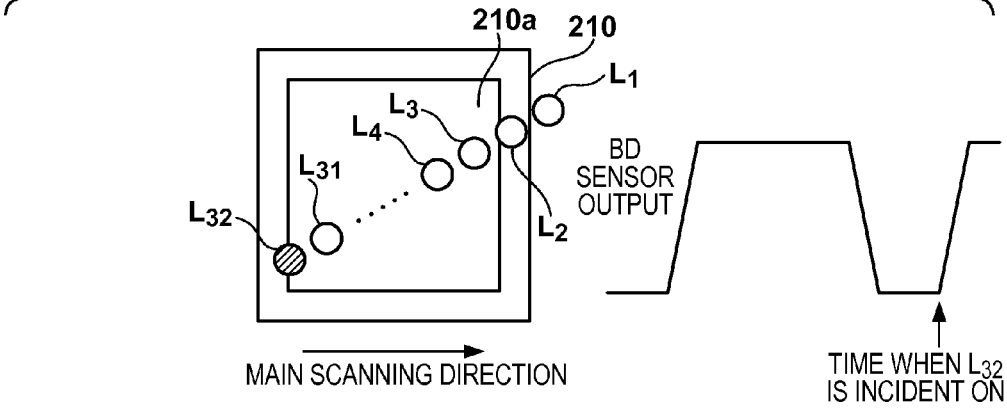

Here, control of the light-emitting portions and the timing thereof during BD interval measurement in which the first and the second light-emitting portions are used will be described with reference to FIGS. 9A to 9C. Note that although a case will be described below in which the light-emitting portions 301 and 332 ($LD_1$ and $LD_{32}$) are used as the two light-emitting portions (first and second light-emitting portions) used in BD interval measurement, it is possible to use any two light-emitting portions in measurement. Also, the third light power control (APCH) is executed as APC that is executed during BD interval measurement. FIGS. 9A to 9C are diagrams showing an example of a relationship between the output from the BD sensor 210 and the state of the laser beams $L_2$ to $L_{32}$ emitted from the light-emitting portions 301 to 332 ($LD_1$ to $LD_{32}$) scanning the light-receiving surface 210*a* of the BD sensor 210.

FIG. 9A shows the scanning state when the laser beam $L_2$ from the light-emitting portion 301 ($LD_1$) is incident on the light-receiving surface 210*a* of the BD sensor 210. Note that the light-emitting portions 302 to 332, which are the light-emitting portions other than the light-emitting portion 301 ($LD_1$), are controlled so as to be in a turned-off state (OFF mode). The CPU 401 controls the optical scanning apparatus 104 such that the light-emitting portion 301 ($LD_1$) is set to the APC mode and the laser beam $L_2$ is incident on the light-receiving surface 210*a* upon the elapse of the time $T_a$ since the start of APC. Accordingly, the light power of the laser beam $L_2$ incident on the BD sensor 210 can be stabilized at the target light power (Ph in FIG. 8A), and it is possible to cause the BD sensor 210 to generate the first BD signal based on the laser beam $L_2$ that has a stable light power.

Thereafter, in order to cause the BD sensor 210 to generate the second BD signal based on the laser beam $L_{32}$ from the light-emitting portion 332 ($LD_{32}$), the CPU 401 performs control for turning off the light-emitting portion 301 ($LD_1$) and turning on (causing light emission) the light-emitting portion 332 ($LD_{32}$). FIG. 9B shows a scanning state when the light-emitting portion 301 ($LD_1$) is turned off and the light-emitting portion 332 ($LD_{32}$) is turned on. Note that here, the time at which the light-emitting portion 301 ($LD_1$) is turned off is the same as the time at which the light-emitting portion 332 ($LD_{32}$) is turned on, but in actuality, a delay can occur between these two times. Also, FIG. 9C shows a scanning state when the laser beam $L_{32}$ from the light-emitting portion 332 ($LD_{32}$) is incident on the light-receiving surface 210*a* of the BD sensor 210.

In FIG. 9B, the time from when the light-emitting portion 332 ($LD_{32}$) is turned on to when the laser beam $L_{32}$ from the light-emitting portion is incident on the light-receiving surface 210*a* (FIG. 9C) is indicated as $T_c$. The time $T_c$ is normally an extremely short time ($T_c<T_a$). For this reason, if APC is to be executed on the light-emitting portion 332 ($LD_{32}$), the laser beam $L_{32}$ ends up being incident on the light-receiving surface 210*a* before the light power of the laser beam $L_{32}$ from the light-emitting portion 332 reaches a state of being stable at the target light power (Ph in FIG. 8A) (before the elapse of time $T_a$). In other words, since time for executing APC cannot be sufficiently ensure for the light-emitting portion 332 ($LD_{32}$) used in BD interval measurement, a BD signal is generated by the BD sensor 210 based on the laser beam $L_{32}$ whose light power is not stable. As a result, the accuracy of BD interval measurement decreases.

In order to deal with this problem, the image forming apparatus 100 of the present embodiment executes APC as light power control on the first light-emitting portion ($LD_1$), which emits the laser beam $L_2$ for causing the BD sensor 210 to generate the first BD signal in BD interval measurement. That is to say, the image forming apparatus 100 (CPU 401) causes the BD sensor 210 to generate the first BD signal in a state in which the value of the driving current supplied to the first light-emitting portion ($LD_1$) is being controlled according to the light power of the laser beam emitted from the first light-emitting portion. That is to say that after the PD 204 receives the laser beam emitted from the first light-emitting portion ($LD_1$), a driving current with a value based on the result of the PD 204 receiving the laser beam is supplied to the first light-emitting portion ($LD_1$), and thereby the image forming apparatus 100 (CPU 401) causes the BD sensor 210 to generate the first BD signal. On the other hand, the image forming apparatus 100 executes not APC but ACC as the light power control on the second light-emitting portion ($LD_{32}$), which emits the laser beam $L_{32}$ for causing the BD sensor 210 to generate the second BD signal that follows the first BD signal. In other words, the image forming apparatus 100 (CPU 401) causes the BD sensor 210 to generate the second BD signal by supplying a driving current with a pre-determined value to the second light-emitting portion ($LD_{32}$).

With the execution of ACC, the time ($T_b$) from when the second light-emitting portion ($LD_{32}$) starts emitting light to when the light power of the laser beam $L_{32}$ becomes stable at a constant light power is extremely short, as shown in FIG. 8B. For this reason, in BD interval measurement, the light power of the laser beam $L_{32}$ can be stabilized in a time that is shorter than the time $T_c$, from when the second light-emitting portion ($LD_{32}$) is turned on to when the laser beam $L_{32}$ is incident on the BD sensor 210 ($T_b<T_c$), and a BD signal based on the laser beam $L_{32}$ with a stable light power can be generated.

In BD interval measurement, the image forming apparatus 100 controls the emission timings of the laser beams such that after the first and second light-emitting portions start emitting laser beams, the laser beams are incident on the BD sensor 210 in a state in which the light power of the laser beams is stable at a constant light power. According to this, it is possible to cause the BD sensor 210 to generate BD signals based on laser beams $L_1$ and $L_{32}$ with stable light powers in both the case of causing the BD sensor 210 to generate the first BD signal and the case of causing the BD sensor 210 to generate the second BD signal. As a result, it is possible to prevent the accuracy of BD interval measurement from decreasing.

In the example shown in FIG. 6, the CPU 401 executes the following control in the case where the BD sensor 210 is to be caused to generate the first BD signal. Here, the PD 204 is an example of a light power detection unit that detects the light power of light beams (laser beams) emitted from the light-emitting portions 301 to 332. In the case where the BD sensor 210 is to be caused to generate the first BD signal, the CPU 401 performs light power control (third light power control) on the light-emitting portion 301, in which the light power of laser beams is controlled by the value of the driving current for the light-emitting portion 301 being controlled according to the light power detected by the PD 204.

Specifically, the terminal 634*com* and the terminal 634-1 are connected due to the mode channel decoder 633 controlling the selector 634 based on the signals from the CPU 401. This forms a closed loop in which the signal output by the comparator 641 based on the detection signal from the PD 204 is fed back to the H hold capacitor 646 (capacitance element). Due to the voltage of the H hold capacitor 646 being controlled based on the signal output by the comparator 641, the value of the driving current supplied to the control target light-emitting portion 301 is controlled such that the light power detected by the PD 204 becomes equal to the target light power Ph. Note that a driving current with a value corresponding to the voltage of the H hold capacitor 646 is supplied to the light-emitting portion 301 as described above, and as a result, the light-emitting portion 301 emits a laser beam with a light power that corresponds to the driving current. Light power control (APC) of the laser beam emitted from the light-emitting portion 301 is performed by controlling this closed loop.

On the other hand, in the case where the BD sensor 210 is to be caused to generate the second BD signal, the CPU 401 executes the following control. In the case where the BD sensor 210 is to be caused to generate the second BD signal, the CPU 401 causes a light beam to be emitted from the second light-emitting portion according to a driving current with a value determined using the above-described light power control (third light power control), which was executed in the past on the second light-emitting portion ($LD_{32}$).

Specifically, the terminal 634*com* and the terminal 634*gnd* are connected due to the mode channel decoder 633 controlling the selector 634 based on the signals from the CPU 401. Accordingly, the above-described closed loop is removed and an open loop is formed, and as a result, a driving current with a value corresponding to the voltage being held in the H hold capacitor 646 (capacitance element) is supplied to the light-emitting portion 332. The voltage being held in the H hold capacitor 646 is a value determined using APC (third light power control) executed in the past on the light-emitting portion 332.

Note that in the case where the BD sensor 210 is to be caused to generate the second BD signal, it is possible to use a constant current source that outputs a driving current with a predetermined value, instead of a driving current with a value corresponding to the voltage being held in the H hold capacitor 646. In this case, it is sufficient to provide such a constant current source in the laser driver 405B in advance and use the driving current output from the constant current source to cause the laser beam to be emitted from the light-emitting portion 332.

Operation Timing Control for Optical Scanning Apparatus

Figure 10A:
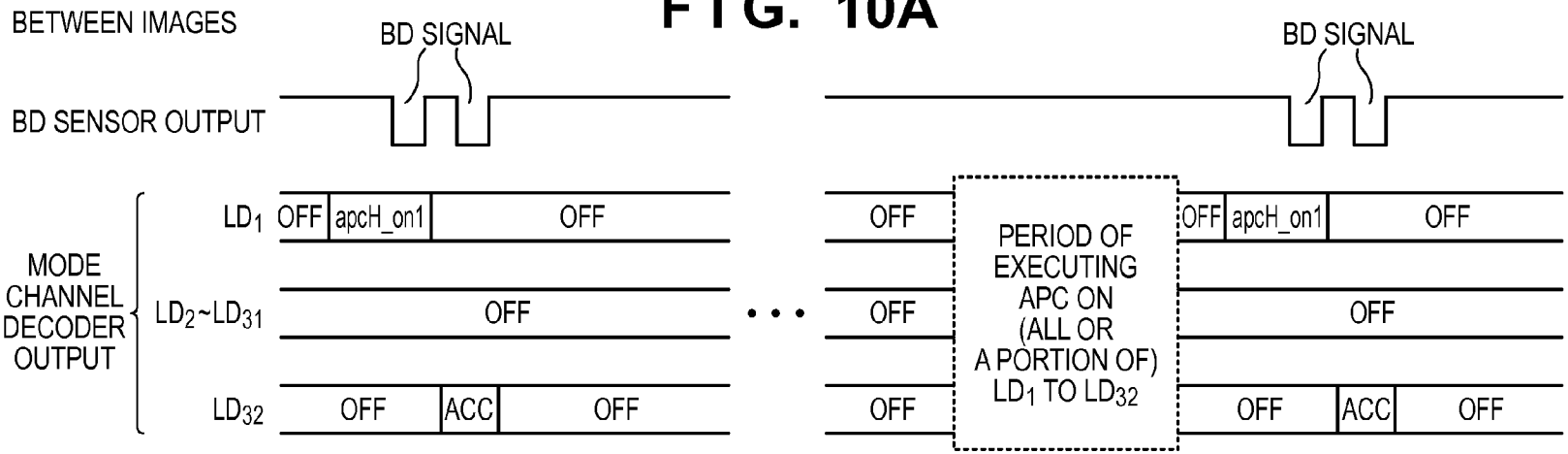
FIGS. 10A and 10B are timing charts showing a timing of operations performed by the optical scanning apparatus when image formation is executed by the image forming apparatus.
Figure 10B:
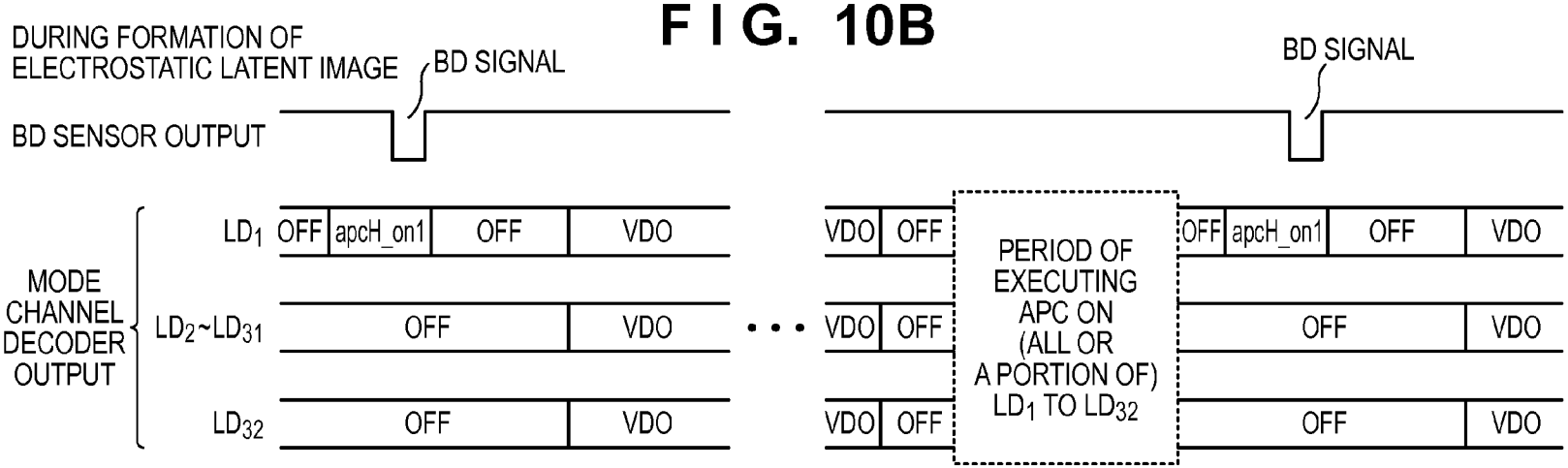

FIGS. 10A and 10B are timing charts showing the timing of operations performed by the optical scanning apparatus 104 when image formation is executed in the image forming apparatus 100 of the present embodiment. FIG. 10A corresponds to a non-image-forming period, or in other words, a period before starting image formation on a recording medium, or a period between a period of forming an electrostatic latent image (image) for one recording medium (first recording medium) and a period of forming an image on the next recording medium (second recording medium). FIG. 10B corresponds to a period of forming an electrostatic latent image (image) on a recording medium.

Non-Image-Forming Period

As shown in FIG. 10A, in the non-image-forming period, the CPU 401 executes one or more instances of BD interval measurement, in which the light-emitting portion 301 ($LD_1$) and the light-emitting portion 332 ($LD_{32}$) are used to cause the BD sensor 210 to generate two BD signals (first detection signal and second detection signal). Note that FIG. 10A shows an example in which one instance of BD interval measurement is performed in each scanning cycle of the multiple laser beams in the non-image-forming period.

Specifically, the CPU 401 controls the light-emitting portion 301, which is set to the OFF mode, so as to be in the APC mode in which the third light power control (APCH) is executed. Based on the mode select signals and the channel select signals output by the CPU 401, the mode channel decoder 633 outputs the APC mode signal apcH_on1, which is set to the H level. According to this, the light-emitting portion 301 emits light and the third light power control is executed by the laser driver 405A on the light-emitting portion 301. Note that the CPU 401 sets the light-emitting portions 302 to 332 ($LD_2$ to $LD_{32}$), which are the light-emitting portions other than the light-emitting portion 301, to the OFF mode.

The CPU 401 controls the laser driver 405A such that the third light power control is started more than time $T_a$ before when the laser beam $L_1$ emitted from the light-emitting portion 301 is incident on the BD sensor 210 (on the light-receiving surface 210*a* thereof). Accordingly, the light power of the laser beam $L_1$ is in a state of being stable at the target light power Ph when the scanned laser beam $L_1$ is incident on the BD sensor 210. As a result, the first BD signal (first detection signal) is generated and output by the BD sensor 210 based on a laser beam $L_1$ with a stable light power.

After the first BD signal (first detection signal) is output from the BD sensor 210, the CPU 401 controls the light-emitting portion 301 so as to be in the OFF mode and subsequently controls the light-emitting portion 332 so as to be in the ACC mode, in which ACC is executed. Based on the mode select signals and the channel select signals output by the CPU 401, the mode channel decoder 633 outputs the ACC mode signal that corresponds to the light-emitting portion 332 and is set to the H level. Accordingly, the light-emitting portion 332 emits light, and ACC is performed on the light-emitting portion 332 by the laser driver 405A. Note that the CPU 401 sets the light-emitting portions 301 to 331 ($LD_1$ to $LD_{31}$), which are the light-emitting portions other than the light-emitting portion 332, to the OFF mode.

The CPU 401 controls the laser driver 405A such that ACC is started more than time $T_b$ before the laser beam $L_{32}$ emitted from the light-emitting portion 332 is incident on the BD sensor 210 (on the light-receiving surface 210*a* thereof). Accordingly, the light power of the laser beam $L_1$ is in a state of being stable at a light power Ph' near the target light power when the scanned laser beam $L_{32}$ is incident on the BD sensor 210. As a result, the second BD signal (second detection signal) is generated and output by the BD sensor 210 based on a laser beam $L_{32}$ with a stable light power.

After the second BD signal (second detection signal) is output from the BD sensor 210, the CPU 401 controls the light-emitting portion 332 so as to be in the OFF mode. Thereafter, in the period of executing APC before the start of the next BD interval measurement or image formation on a recording medium, the CPU 401 executes APC on all or a portion of the light-emitting portions 301 to 332 ($LD_1$ to $L_{D32}$) (i.e., at least one light-emitting portion) in sequence in a time-divided manner. In this way, in the present embodiment, an APC execution period is provided in each laser beam scanning cycle.

The CPU 401 executes APC on the light-emitting portions in sequence while switching the light-emitting portion on which APC (first, second, or third APC) is to be executed in sequence according to the number of light-emitting portions on which APC can be executed in the APC execution period in each laser beam scanning cycle. For example, if four instances of APC can be executed in one APC execution period, in each APC execution period, the CPU 401 performs switching on four light-emitting portions on which APC is to be executed.

The CPU 401 uses a group of APC mode signals emitted by the mode channel decoder 633 (APC mode signals apcH_on1 to 32, apcM_on1 to 32, apcL_on1 to 32) to control the timing according to which APC (first, second, or third light power control) is executed on the light-emitting portions. That is to say, among the APC mode signals apcH_on1 to 32, apcM_on1 to 32, and apcL_on1 to 32, the CPU 401 sets the signal that corresponds to the APC to be executed (first, second, or third light power control) and corresponds to the light-emitting portion on which APC is to be executed to the H level, and sets all other signals to the L level. Note that the first, second, and third light power control for the same light-emitting portion may be executed continuously in the APC execution period of one scanning cycle, and they may be executed separately in the APC execution periods of different scanning cycles.

If two or more instances of BD interval measurement can be executed in a non-image-forming period as shown in FIG. 10A, the CPU 401 repeatedly executes BD interval measurement after the APC execution period in each laser beam scanning cycle. Specifically, after the APC execution period ends, the CPU 401 controls all of the light-emitting portions so as to be in the OFF mode. Thereafter, the CPU 401 once again executes BD interval measurement, similarly to the above-described procedure.

Image Forming Period

As shown in FIG. 10B, in an image forming period, the CPU 401 uses the light-emitting portion 301 ($LD_1$) to cause the BD sensor 210 to generate a single BD signal (detection signal). Furthermore, the CPU 401 uses the BD signal as a reference to control the relative timings according to which the light-emitting portions emit the laser beams based on image data. At that time, the relative timings according to which the light-emitting portions emit the laser beams are controlled by the CPU 401 according to the BD interval measurement result, which was obtained using BD interval measurement in a prior non-image-forming period. Accordingly, the writing start positions in the main scanning direction of the electrostatic latent image formed by the laser beams emitted from the light-emitting portions are aligned.

Specifically, similarly to when BD interval measurement is executed as described above, the CPU 401 controls the light-emitting portion 301, which is set to the OFF mode, so as to be in the APC mode in which the third light power control (APCH) is executed. According to this, the light-emitting portion 301 emits light and the third light power control is executed by the laser driver 405A on the light-emitting portion 301. Note that the CPU 401 sets the light-emitting portions 302 to 332 ($LD_2$ to $LD_{32}$), which are the light-emitting portions other than the light-emitting portion 301, to the OFF mode.

The CPU 401 controls the laser driver 405A such that the third light power control is started more than time $T_a$ before when the laser beam $L_1$ emitted from the light-emitting portion 301 is incident on the BD sensor 210 (on the light-receiving surface 210*a* thereof). Accordingly, the light power of the laser beam $L_1$ is in a state of being stable at the target light power Ph when the scanned laser beam $L_1$ is incident on the BD sensor 210. As a result, a BD signal is generated and output by the BD sensor 210 based on a laser beam $L_1$ with a stable light power.

Next, after the light-emitting portion 301 is controlled so as to be in the OFF mode, the CPU 401 controls the light-emitting portions 301 to 332 so as to be in the VDO mode according to a timing based on the BD signal. According to this, an electrostatic latent image is formed on the photosensitive drum 102 by laser beams based on image data that are emitted from the light-emitting portions. When the formation of one line of the electrostatic latent image ends, the CPU 401 controls the light-emitting portions 301 to 332 so as to be in the OFF mode.

Thereafter, in an APC execution period before the start of formation of the next line of the electrostatic latent image (image), the CPU 401 executes APC on all or a portion of the light-emitting portions 301 to 332 ($LD_1$ to $LD_{32}$) (i.e., one or more light-emitting portion) in sequence in a time-divided manner. Note that the procedure of executing APC on the light-emitting portions is similar to the procedure described using FIG. 10A.

When the APC execution period ends, using a procedure similar to that described above, the CPU 401 once again uses the light-emitting portion 301 to cause the BD sensor 210 to generate a single BD signal (detection signal) and perform formation of one line of the electrostatic latent image (image). The CPU 401 repeats the above-described procedure until image formation on one recording medium ends.

Variation

Figure 11A:
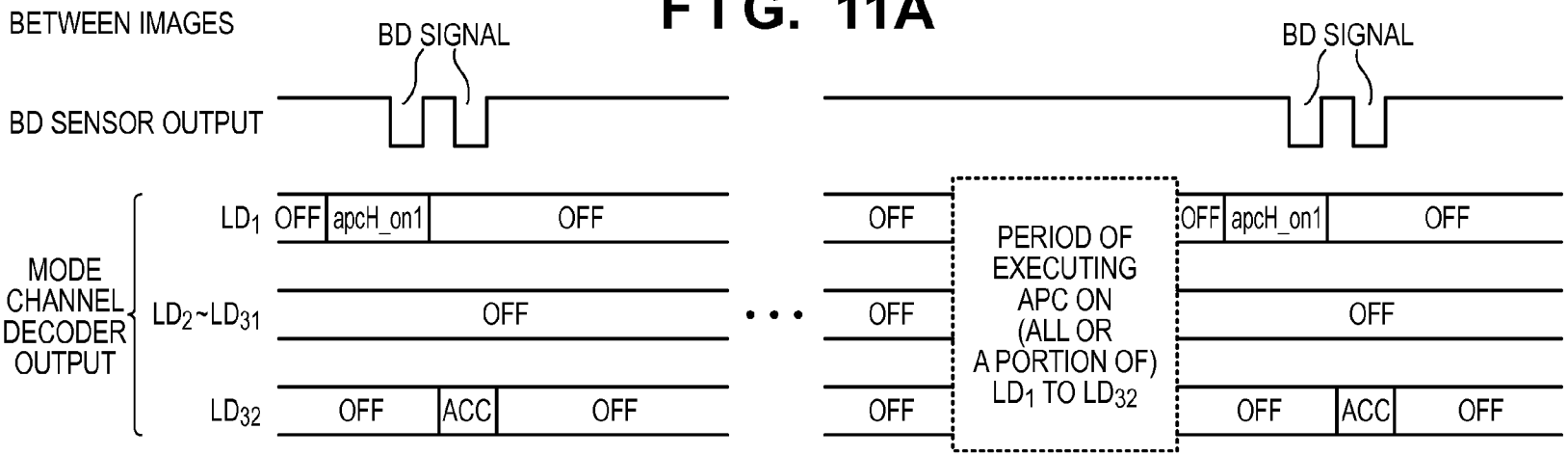
FIGS. 11A and 11B are timing charts showing a timing of operations performed by the optical scanning apparatus (modified example) when image formation is executed by the image forming apparatus.
Figure 11B:
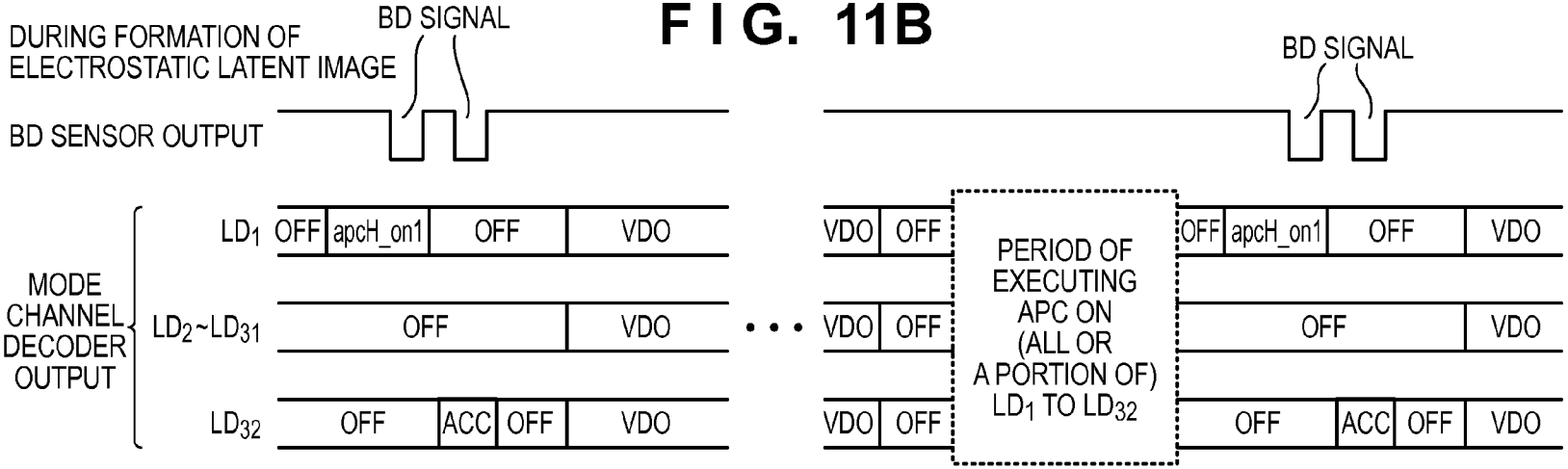

FIGS. 11A and 11B are timing charts showing a variation on FIGS. 10A and 10B. FIG. 11A corresponds to a non-image-forming period and FIG. 11B corresponds to an image forming period. FIGS. 11A and 11B show an example in which one instance of BD interval measurement is performed in each scanning cycle of multiple laser beams in a non-image-forming period and an image forming period.

Control in the non-image-forming period (FIG. 11A) is similar to that shown in FIG. 10A. On the other hand, control in the image forming period differs in that, in FIG. 10B, the BD sensor 210 is caused to generate a single BD signal, whereas in FIG. 11B, BD interval measurement is executed. In this case, the CPU 401 uses the first BD signal generated by the BD sensor 210 in BD interval measurement as a reference to control the relative emission timings according to which the light-emitting portions emit the laser beams based on image data. Thus, according to the example shown in FIGS. 11A and 11B, the first BD signal can be used (shared) not only in BD interval measurement, but also in controlling the relative timings according to which the laser beams are emitted based on image data.

As described above, in BD interval measurement, the image forming apparatus 100 of the present embodiment executes APC as light power control on the first light-emitting portion ($LD_1$), which emits the laser beam $L_1$ for causing the BD sensor 210 to generate the first BD signal. On the other hand, rather than APC, ACC is executed as light power control on the second light-emitting portion ($LD_{32}$), which emits the laser beam $L_{32}$ for causing the BD sensor 210 to generate the second BD signal, which follows the first BD signal. Accordingly, even if sufficient time for executing APC on the second light-emitting portion cannot be reserved, according to ACC, it is possible to rapidly stabilize the light power of the laser beam emitted from the second light-emitting portion. As a result, it is possible to prevent the accuracy of BD interval measurement from decreasing.

Note that in the present embodiment, the multiple light-emitting portions (light-emitting portions 301 to 332) are arranged linearly in one line in the semiconductor laser 200. In this case, if the first and second light-emitting portions used in BD interval measurement are light-emitting portions arranged at one end and the other end (light-emitting portions 301 and 332) of the multiple light-emitting portions (light-emitting portions 301 to 332), the following advantage in particular is obtained. That is to say that since the interval between when the laser beams from the first and second light-emitting portions are incident on the BD sensor 210 can be widened to the greatest extent, ACC can be used to cause a laser beam with a light power that is more reliably stable to be incident on the BD sensor 210 from the light-emitting portion 332.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076459, filed Apr. 2, 2014, which is hereby incorporated by reference herein in its entirety.

What is claimed is:

1. An image forming apparatus comprising:

a light source including a plurality of light-emitting portions that are each configured to emit a light beam for exposing a photosensitive member;

a first light receiving unit configured to receive a plurality of light beams emitted from the plurality of light-emitting portions;

a deflection unit configured to deflect a plurality of light beams emitted from the plurality of light-emitting portions, such that the plurality of light beams scan the photosensitive member;

a second light receiving unit configured to, in response to receiving a light beam deflected by the deflection unit, generate a detection signal indicating that the light beam has been received;

a current control unit configured to execute light power control of causing the plurality of light-emitting elements to emit light individually and controlling a driving current which is supplied to each of the plurality of light-emitting portions based on a light reception result of the first light receiving unit receiving a light beam emitted from each of the plurality of the light-emitting portions, and supply a driving current with a pre-determined value to at least a second light-emitting portion among the plurality of light-emitting portions, the current control unit being configured to supply driving currents to a first light-emitting portion and the second light-emitting portion among the plurality of light-emitting portions such that light beams emitted from the first light-emitting portion and the second light-emitting portion are incident on the second light receiving unit in sequence; and a timing control unit configured to measure a time interval between a first detection signal generated due to the second light receiving unit receiving a light beam from the first light-emitting portion and a second detection signal generated due to the second light receiving unit receiving a light beam from the second light-emitting portion, and based on the time interval, control relative emission timings according to which the plurality of light-emitting portions emit the plurality of light beams, wherein the current control unit is configured to:

cause the second light receiving unit to generate the first detection signal by supplying, to the first light-emitting portion, a driving current with a value based on a light reception result of the first light receiving unit receiving the light beam emitted from the first light-emitting portion; and cause the second light receiving unit to generate the second detection signal by supplying a driving current with a pre-determined value to the second light-emitting portion.

2. The image forming apparatus according to claim 1, wherein the current control unit is configured to control the timings according to which the first and second light-emitting portions emit the light beams, such that after the first and second light-emitting portions start light beam emission, the light beams are incident on the second light receiving unit in a state where a light power of each of the light beams is stable at a constant light power.

3. The image forming apparatus according to claim 1, wherein the current control unit is configured to, in a case of causing the second light receiving unit to generate the second detection signal, cause the second light-emitting portion to emit a light beam based on a driving current with a value determined using the light power control previously executed on the second light-emitting portion.

4. The image forming apparatus according to claim 1, further comprising:

a constant current source configured to output a driving current with the predetermined value, wherein the current control unit is configured to, in a case of causing the second light receiving unit to generate the second detection signal, cause the second light-emitting portion to emit a light beam based on the driving current output from the constant current source.

5. The image forming apparatus according to claim 1, wherein in the light power control, a value of a driving current supplied to a light-emitting portion that is a control target is controlled such that a light power obtained as a light reception result of the first light receiving unit becomes equal to a target light power.

6. The image forming apparatus according to claim 1, wherein in the light power control, a voltage of a capacitance element provided for a light-emitting portion that is a control target is controlled according to a light power obtained as a light reception result of the first light receiving unit, and a driving current with a value corresponding to the voltage of the capacitance element is supplied to the light-emitting portion.

7. The image forming apparatus according to claim 1, wherein the timing control unit is configured to, in a non-image-forming period during which image formation on a recording medium is not performed, execute measurement of the time interval once in each scanning cycle of the plurality of light beams, and the timing control unit is configured to, in an image forming period which is after the non-image-forming period and during which image formation on a recording medium is performed, control the light source such that the light beam from the first light-emitting portion is incident on the second light receiving unit, and control, based on one detection signal generated by the second light receiving unit and the time interval obtained by the measurement, relative timings at which the plurality of light-emitting portions emit light beams based on image data.

8. The image forming apparatus according to claim 1, wherein the timing control unit is configured to, in a non-image-forming period during which image formation on a recording medium is not performed and an image forming period during which image formation on a recording medium is performed, execute measurement of the time interval once in each scanning cycle of the plurality of light beams, and the timing control unit is configured to, based on the first detection signal generated by the second light receiving unit in the measurement performed in the image forming period, and the time interval obtained by the measurement, control relative timings at which the plurality of light-emitting portions emit light beams based on image data.

9. The image forming apparatus according to claim 1, wherein the current control unit is configured to execute the light power control in a time-divided manner on at least one of the plurality of light-emitting portions in an execution period provided in each scanning cycle of the plurality of light beams.

10. The image forming apparatus according to claim 9, wherein the current control unit is configured to, in each scanning cycle, sequentially switch a light-emitting portion on which the light power control is executed, according to a number of light-emitting portions on which the light power control can be executed in the execution period.

11. The image forming apparatus according to claim 1, wherein the plurality of light-emitting portions are arranged linearly in one line such that positions that are different in a rotation direction of the photosensitive member and that are different in a scanning direction in which light beams scan the photosensitive member are exposed, and the first and second light-emitting portions are light-emitting portions arranged on one end and another end of the plurality of light-emitting portions.

12. The image forming apparatus according to claim 1, wherein the light source is a surface-emitting laser.

13. The image forming apparatus according to claim 1, further comprising:

the photosensitive member;

a charging unit configured to charge the photosensitive member; and a developing unit configured to develop an electrostatic latent image formed on the photosensitive member by scanning of the plurality of light beams using toner so as to form, on the photosensitive member, an image that is to be transferred onto a recording medium on the photosensitive member.

* * * * *